US008261841B2

(12) United States Patent
Bailey et al.

(10) Patent No.: US 8,261,841 B2
(45) Date of Patent: Sep. 11, 2012

(54) COATED OIL AND GAS WELL PRODUCTION DEVICES

(75) Inventors: Jeffrey Roberts Bailey, Houston, TX (US); Erika Ann Ooten Biediger, Houston, TX (US); Narasimha-Rao Venkata Bangaru, Pittstown, NJ (US); Swarupa Soma Bangaru, legal representative, Pittstown, NJ (US); Adnan Ozekcin, Bethlehem, PA (US); Hyun-Woo Jin, Easton, PA (US); Charles Shiao-Hsiung Yeh, Spring, TX (US); Michael D. Barry, The Woodlands, TX (US); Michael T. Hecker, Tomball, TX (US); Mehmet Deniz Ertas, Bethlehem, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 275 days.

(21) Appl. No.: 12/583,302

(22) Filed: Aug. 18, 2009

(65) Prior Publication Data

US 2010/0206553 A1 Aug. 19, 2010

Related U.S. Application Data

(60) Provisional application No. 61/207,814, filed on Feb. 17, 2009.

(51) Int. Cl.
*E21B 17/10* (2006.01)

(52) U.S. Cl. ..... 166/380; 166/242.4; 166/902

(58) Field of Classification Search ..... 166/902, 166/380, 242.4; 175/226
See application file for complete search history.

(56) References Cited

U.S. PATENT DOCUMENTS

| | | | |
|---|---|---|---|
| 4,171,560 | A | 10/1979 | Garrett |
| 4,665,996 | A | 5/1987 | Foroulis et al. |
| 4,945,991 | A | 8/1990 | Jones |
| 5,113,935 | A | 5/1992 | Jones et al. |
| 5,163,524 | A | 11/1992 | Newton, Jr. et al. |
| 5,541,003 | A | 7/1996 | Nakayama et al. |
| 5,626,963 | A | 5/1997 | Hirano et al. |

(Continued)

FOREIGN PATENT DOCUMENTS

EP 1 788 104 B1 11/2005

(Continued)

OTHER PUBLICATIONS

Co-pending U.S. Appl. No. 61/189,530.

(Continued)

*Primary Examiner* — William P Neuder
(74) *Attorney, Agent, or Firm* — Robert A. Migliorini

(57) ABSTRACT

Provided are coated oil and gas well production devices and methods of making and using such coated devices. In one form, the coated oil and gas well production device includes an oil and gas well production device including one or more bodies, and a coating on at least a portion of the one or more bodies, wherein the coating is chosen from an amorphous alloy, a heat-treated electroless or electro plated based nickel-phosphorous composite with a phosphorous content greater than 12 wt %, graphite, $MoS_2$, $WS_2$, a fullerene based composite, a boride based cermet, a quasicrystalline material, a diamond based material, diamond-like-carbon (DLC), boron nitride, and combinations thereof. The coated oil and gas well production devices may provide for reduced friction, wear, corrosion, erosion, and deposits for well construction, completion and production of oil and gas.

148 Claims, 26 Drawing Sheets

Coefficient of friction (COF) versus Vickers hardness

U.S. PATENT DOCUMENTS

| | | | | |
|---|---|---|---|---|
| 5,629,086 | A | 5/1997 | Hirano et al. | |
| 5,653,812 | A | 8/1997 | Petrmichl et al. | |
| 5,707,717 | A | 1/1998 | Shibahara et al. | |
| 5,803,193 | A | 9/1998 | Krueger et al. | |
| 6,165,616 | A | 12/2000 | Lemelson et al. | |
| 6,209,185 | B1 | 4/2001 | Scott | |
| 6,250,405 | B1 | 6/2001 | Moore et al. | |
| 6,378,633 | B1 | 4/2002 | Moore et al. | |
| 6,450,271 | B1 | 9/2002 | Tibbitts et al. | |
| 6,548,173 | B2 | 4/2003 | Erdemir et al. | |
| 6,742,586 | B2 | 6/2004 | Lauritzen et al. | |
| 6,764,714 | B2 | 7/2004 | Wei et al. | |
| 7,028,788 | B2 | 4/2006 | Strand et al. | |
| 7,052,736 | B2 | 5/2006 | Wei et al. | |
| 7,228,922 | B1 | 6/2007 | DeVall | |
| 7,234,541 | B2 | 6/2007 | Scott et al. | |
| 7,300,684 | B2 | 11/2007 | Boardman et al. | |
| 7,444,955 | B2 | 11/2008 | Boardman et al. | |
| 7,464,752 | B2 | 12/2008 | Dale et al. | |
| 7,487,840 | B2 | 2/2009 | Gammage et al. | |
| 7,541,069 | B2 | 6/2009 | Tudhope et al. | |
| 7,556,668 | B2 | 7/2009 | Eason et al. | |
| 7,673,679 | B2 * | 3/2010 | Harrison et al. | 166/250.01 |
| 2003/0094869 | A1 | 5/2003 | Ameen et al. | |
| 2004/0031624 | A1 | 2/2004 | Scott et al. | |
| 2004/0256236 | A1 | 12/2004 | Minevski et al. | |
| 2005/0103497 | A1 | 5/2005 | Gondouin | |
| 2005/0146086 | A1 | 7/2005 | Pope et al. | |
| 2007/0209839 | A1 | 9/2007 | Arnoldy | |
| 2008/0127475 | A1 | 6/2008 | Griffo | |
| 2008/0236842 | A1 | 10/2008 | Bhavsar et al. | |
| 2008/0314646 | A1 | 12/2008 | Lockwood et al. | |
| 2009/0017317 | A1 | 1/2009 | Lancsek et al. | |

FOREIGN PATENT DOCUMENTS

| | | | |
|---|---|---|---|
| EP | 2 090 741 | A1 | 8/2009 |
| WO | WO 02/103161 | A2 | 12/2002 |
| WO | WO2005/111264 | | 11/2005 |
| WO | WO 2007/091054 | A1 | 8/2007 |
| WO | WO2007/092082 | | 8/2007 |
| WO | WO2007/092083 | | 8/2007 |
| WO | WO2007/026496 | | 11/2007 |
| WO | WO2008/060479 | | 5/2008 |

OTHER PUBLICATIONS

Co-pending U.S. Appl. No. 12/583,292, filed Aug. 18, 2009.

Dudman, Rick A., West, Cory and Hubbard, Jeff, "Low-Stress Level PinUp Drillstring Optimizes Drilling of 20,000 ft. Slim-Hole in Southern Oklahoma", SPE/IADC Drilling Conference, Amsterdam, Holland, Mar. 9-11, 1999.

Dudman, R. A., Stull, T., and Keane, T., "Pin-up Drillstring Technology: Design, Application, and Case Histories", SPE/IADC Drilling Conference, New Orleans, Louisiana, Feb. 28-Mar. 3, 1989.

* cited by examiner

Exemplary Oil and Gas Well Production System Elements

Images from: A Dictionary for the Petroleum Industry, Third Edition, The University of Texas at Austin, Petroleum Extension Service, 2001, p. 67,89,108,111,126,137, permission pending.

FIGURE 2
Exemplary Applications of Coatings on Drill Stem Assemblies
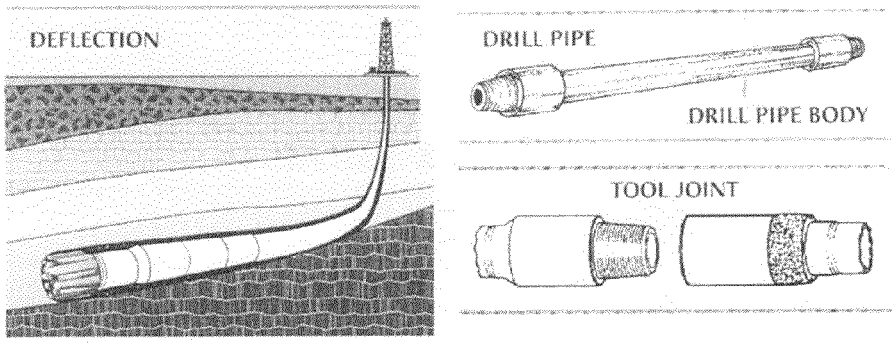
Images from: A Dictionary for the Petroleum Industry, Third Edition, The University of Texas at Austin, Petroleum Extension Service, 2001, p. 61,74,253, permission pending.
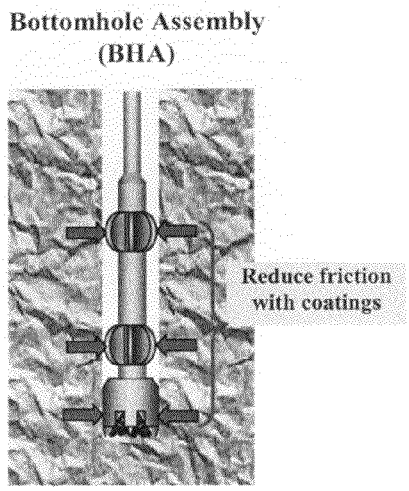
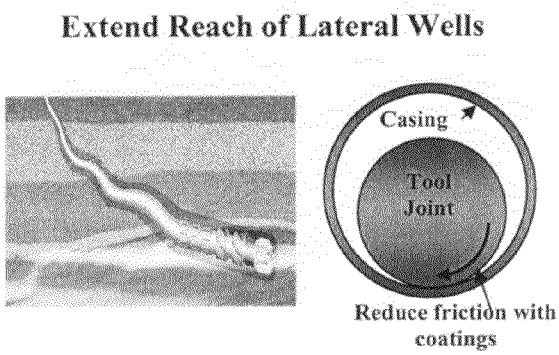

FIGURE 3

Exemplary Application of Coatings on Bottomhole Assembly Devices

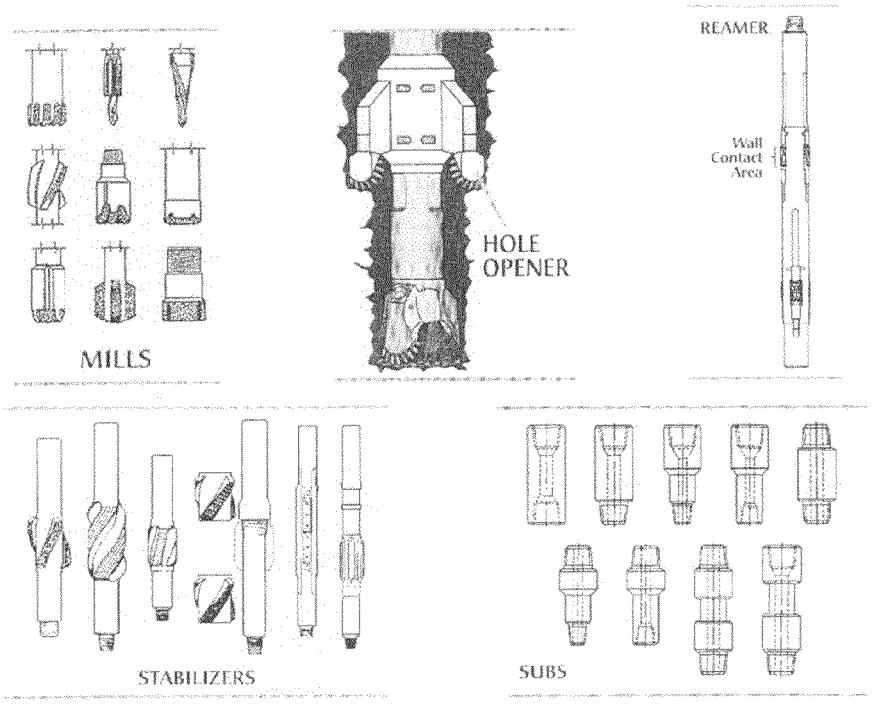

Coatings applied to BHA components will reduce friction and wear at contact points with the open hole and lengthen tool life. Low surface energy of coatings will inhibit sticking of formation to the tools. Corrosion and erosion limits may also be extended.

Images from: A Dictionary for the Petroleum Industry, Third Edition, The University of Texas at Austin, Petroleum Extension Service, 2001, p. 117,154,199,233,239, permission pending.

Exemplary Applications of Coatings on Marine Riser Systems

Images from: A Dictionary for the Petroleum Industry, Third Edition, The University of Texas at Austin, Petroleum Extension Service, 2001, p. 207,240,249, permission pending.

FIGURE 5
Exemplary Applications of Coatings on Rod Pumping Devices
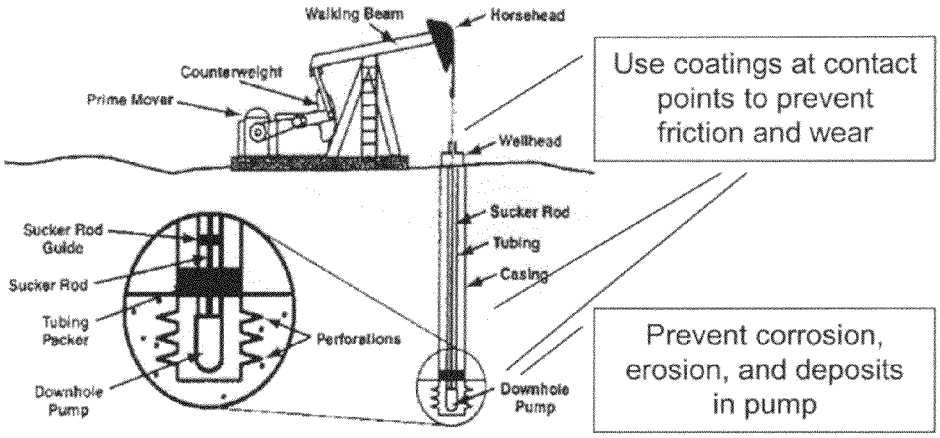
Image from: http://www.mosburgoil-gas.com/html/body_hyne_10_99_2a.html, permission pending.
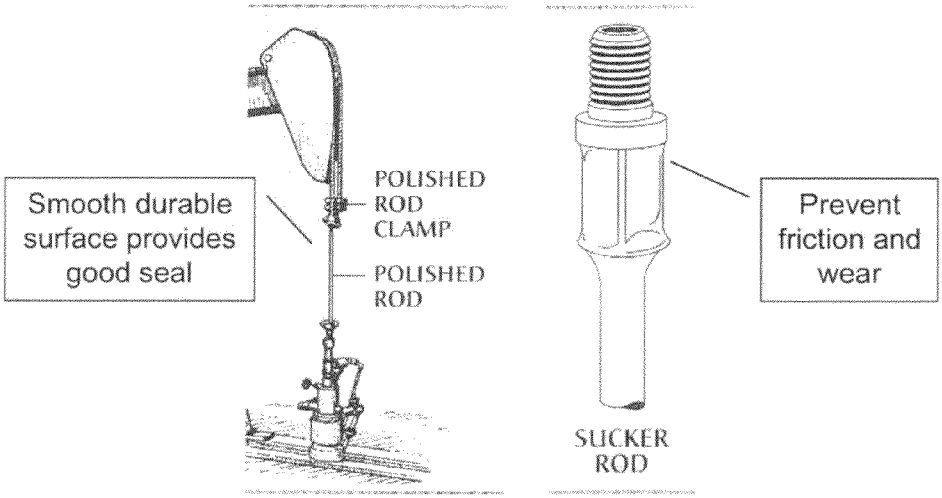
Images from: A Dictionary for the Petroleum Industry, Third Edition, The University of Texas at Austin, Petroleum Extension Service, 2001, p. 185,240, permission pending.

FIGURE 6

Exemplary Applications of Coatings on Wireline, Logging Tools, and Packers

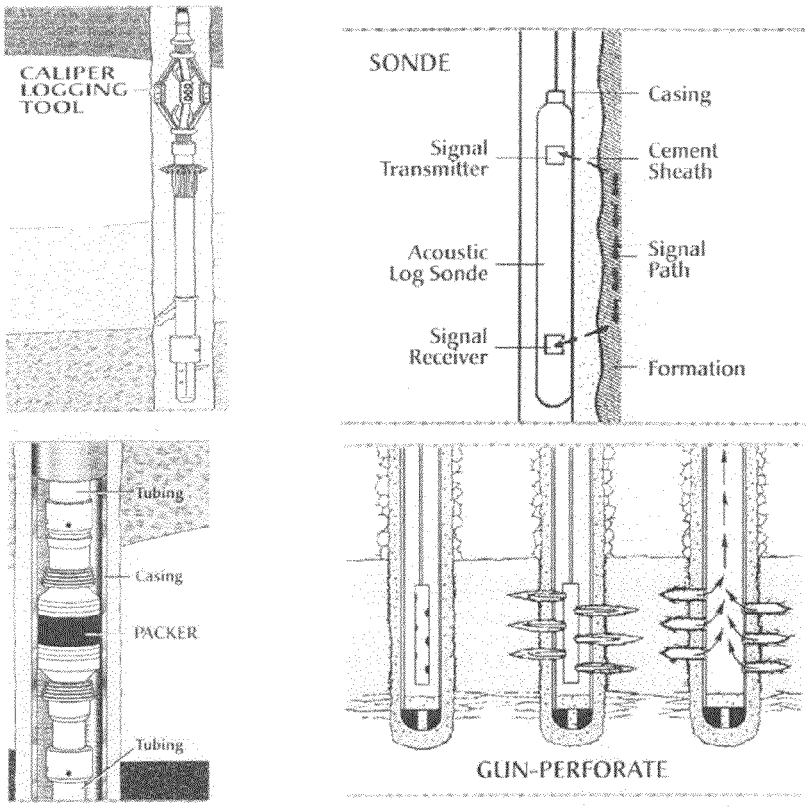

Coatings applied to wireline, logging tools, and packers will reduce friction and wear at contact points with the open hole or casing, extending applications of wireline in extended-reach wells and enlarging the application envelope. Low surface energy of coatings will inhibit sticking of formation to the tools. Corrosion and erosion limits may also be extended.

Images from: A Dictionary for the Petroleum Industry, Third Edition, The University of Texas at Austin, Petroleum Extension Service, 2001, p. 32,111,175,228, permission pending.

Exemplary Applications of Coatings on Wireline and Wirerope

Images from: A Dictionary for the Petroleum Industry, Third Edition, The University of Texas at Austin, Petroleum Extension Service, 2001, p. 274,275, permission pending.

Exemplary Applications of Coatings on Screens and Basepipe

Images from: A Dictionary for the Petroleum Industry, Third Edition, The University of Texas at Austin, Petroleum Extension Service, 2001, p. 141,220,226,275, permission pending.

Exemplary Applications of Coatings on Wellheads, Valves, and Sealing Devices

Images from: A Dictionary for the Petroleum Industry, Third Edition, The University of Texas at Austin, Petroleum Extension Service, 2001, p. 23,103,145,264,272, permission pending.

Exemplary Applications of Coatings on Chokes, Rotors, and Flow Devices

Images from: A Dictionary for the Petroleum Industry, Third Edition, The University of Texas at Austin, Petroleum Extension Service, 2001, p. 41,172,259, permission pending.

Exemplary Applications of Coatings on Fishing Devices

Images from: A Dictionary for the Petroleum Industry, Third Edition, The University of Texas at Austin, Petroleum Extension Service, 2001, p. 91,108,269, permission pending.

FIGURE 12

Exemplary Applications of Coatings to Prevent Deposits in Tubular Goods

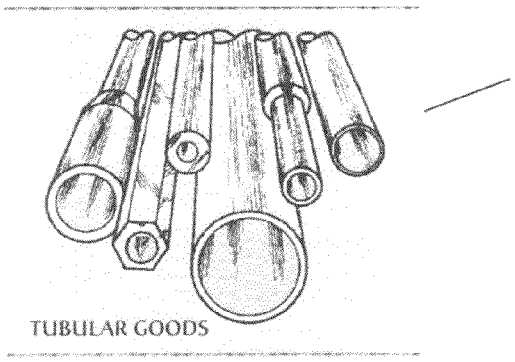

Tubulars with full inner diameter and no scale, asphaltene, paraffin, or hydrate deposits

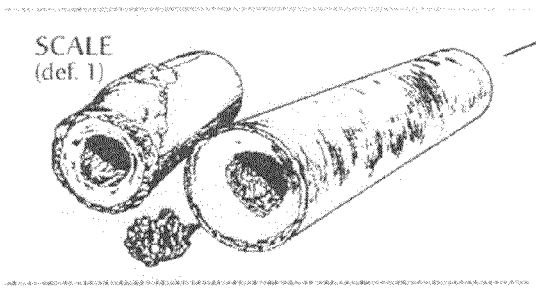

Tubulars with scale or other deposits have restricted flow capacity and prevent wellbore access with logging tools. Low surface energy coatings can prevent deposition.

Images from: A Dictionary for the Petroleum Industry, Third Edition, The University of Texas at Austin, Petroleum Extension Service, 2001, p. 215,258, permission pending.

FIGURE 13

Exemplary Applications of Coatings on Threaded Connections

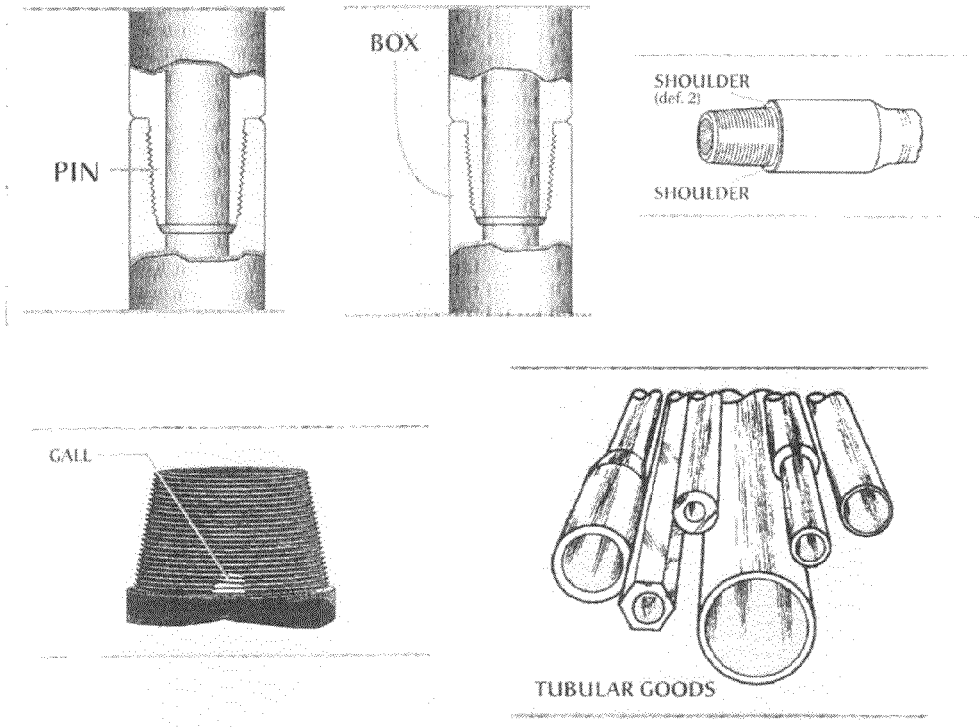

Most tubular goods in the oil and gas industry are assembled with threaded connections. Connection makeup and galling issues are however common. Surface treatment of a portion of the connection with coatings may improve threaded connections.

Images from: A Dictionary for the Petroleum Industry, Third Edition, The University of Texas at Austin, Petroleum Extension Service, 2001, p.26,101,181,222,258, permission pending.

Schematic of Rate of Penetration (ROP) versus Weight on Bit (WOB)

Coefficient of friction (COF) versus Vickers hardness

Representative stress-strain curve of exemplary amorphous and crystalline alloys Schematic ternary phase diagram of amorphous carbons Schematic illustration of hydrogen dangling bond theory.

Performance of DLC coating at dry sliding wear test

Performance of DLC coating at wear test in oil based mud.

Performance of DLC coating at elevated temperature (150°F) sliding wear test in oil based mud.

Friction performance of DLC coating at elevated temperatures (150°F and 200°F) in sliding tests using oil based mud COF of an uncoated versus DLC-coated steel substrate as a function of sliding velocity.

SEM cross-sections of single layer and multi layered DLC coatings with "adhesion" or buffer layers.

Water contact angle for DLC coatings versus uncoated 4142 steel.

Exemplary schematic of hybrid DLC coating on hardbanding.

COATED OIL AND GAS WELL PRODUCTION DEVICES

CROSS-REFERENCE TO RELATED APPLICATIONS

This is a Non-Provisional Application that claims priority to U.S. Provisional Application 61/207,814 filed Feb. 17, 2009, which is herein incorporated by reference in its entirety.

FIELD

The present disclosure relates to the field of oil and gas well production operations. It more particularly relates to the use of coatings to reduce friction, wear, corrosion, erosion, and deposits on oil and gas well production devices. Such coated oil and gas well production devices include drilling rig equipment, marine riser systems, tubular goods (casing, tubing, and drill strings), wellhead, trees, and valves, completion strings and equipment, formation and sandface completions, artificial lift equipment, and well intervention equipment.

BACKGROUND

Oil and gas well production suffers from basic mechanical problems that may be costly, or even prohibitive, to correct, repair, or mitigate. Friction is ubiquitous in the oilfield, devices that are in moving contact wear and lose their zo original dimensions, devices may be degraded by corrosion and erosion, and deposits on devices can stick and impede their operation. These are all potential impediments to successful operations, and all five mechanical problems, friction, wear, corrosion, erosion, and deposits, may be mitigated by selective use of coatings as described below.

Drilling Rig Equipment:

Following the identification of a specific location as a prospective hydrocarbon area, production operations commence with the mobilization and operation of a drilling rig. In rotary drilling operations, a drill bit is attached to the end of a bottom hole assembly, which is attached to a drill string comprising drill pipe and tool joints. The drill string may be rotated at the surface by a rotary table or top drive unit, and the weight of the drill string and bottom hole assembly causes the rotating bit to bore a hole in the earth. As the operation progresses, new sections of drill pipe are added to the drill string to increase its overall length. Periodically during the drilling operation, the open borehole is cased to stabilize the walls, and the drilling operation is resumed. As a result, the drill string usually operates both in the open borehole ("open-hole") and within the casing which has been installed in the borehole ("cased-hole"). Alternatively, coiled tubing may replace drill string in the drilling assembly. The combination of a drill string and bottom hole assembly or coiled tubing and bottom hole assembly is referred to herein as a drill stem assembly. Rotation of the drill string provides power through the drill string and bottom hole assembly to the bit. In coiled tubing drilling, power is delivered to the bit by the drilling fluid. The amount of power which can be transmitted by rotation is limited to the maximum torque a drill string or coiled tubing can sustain.

In an alternative and unusual drilling method, the casing itself is used to drill into the earth formations. Cutting elements are affixed to the bottom end of the casing, and the casing may be rotated to turn the cutting elements. In the discussion that follows, reference to the drill stem assembly will include a "drilling casing string" that is used to drill the earth formations in this "casing-while-drilling" method.

During the drilling of a borehole through underground formations, the drill stem assembly undergoes considerable sliding contact with both the steel casing and rock formations. This sliding contact results primarily from the rotational and axial movements of the drill stem assembly in the borehole. Friction between the moving surface of the drill stem assembly and the stationary surfaces of the casing and formation creates considerable drag on the drill stem and results in excessive torque and drag during drilling operations. The problem caused by friction is inherent in any drilling operation, but it is especially troublesome in directionally drilled wells or extended reach drilling (ERD) wells. Directional drilling or ERD is the intentional deviation of a wellbore from the vertical. In some cases the inclination (angle from the vertical) may be as great as ninety degrees. Such wells are commonly referred to as horizontal wells and may be drilled to a considerable depth and considerable distance from the drilling platform.

In all drilling operations, the drill stem assembly has a tendency to rest against the side of the borehole or the well casing, but this tendency is much greater in directionally drilled wells because of the effect of gravity. The drill stem may also locally rest against the borehole wall or casing in areas where the local curvature of the borehole wall or casing is high. As the drill string increases in length or degree of vertical deflection, the amount of friction created by the rotating drill stem assembly also increases. Areas of increased local curvature may increase the amount of friction generated by the rotating drill stem assembly. To overcome this increase in friction, additional power is required to rotate the drill stem assembly. In some cases, the friction between the drill stem assembly and the casing wall or borehole exceeds the maximum torque that can be tolerated by the drill stem assembly and/or maximum torque capacity of the drill rig and drilling operations must cease. Consequently, the depth to which wells can be drilled using available directional drilling equipment and techniques is ultimately limited by friction.

One string of pipe in sliding contact motion relative to an outer pipe, or more generally, an inner cylinder moving within an outer cylinder, is a common geometric configuration in several of these operations. One prior art method for reducing the friction caused by the sliding contact between strings of pipe is to improve the lubricity of the annular fluid. In industry operations, attempts have been made to reduce friction through, mainly, using water and/or oil based mud solutions containing various types of expensive and often environmentally unfriendly additives. For many of these additives the increased lubricity gained from these additives decreases as the temperature of the borehole increases. Diesel and other mineral oils are also often used as lubricants, but there may be problems with the disposal of the mud, and these fluids also lose lubricity at elevated temperatures. Certain minerals such as bentonite are known to help reduce friction between the drill stem assembly and an open borehole. Materials such as Teflon have been used to reduce sliding contact friction, however these lack durability and strength. Other additives include vegetable oils, asphalt, to graphite, detergents, glass beads, and walnut hulls, but each has its own limitations.

Another prior art method for reducing the friction between pipes is to use aluminum material for the inner string because aluminum is lighter than steel. However, aluminum is expensive and may be difficult to use in drilling operations, it is less abrasion-resistant than steel, and it is not compatible with many fluid types (e.g. fluids with high pH). Alternatively, the industry has developed means to "float" an inner string within an outer string to run casing and liner at high inclinations, but circulation is restricted during this operation and it is not amenable to the hole-making process.

Yet another method for reducing the friction between strings of pipe is to use a hard facing material on the inner string (also referred to herein as hardbanding or hardfacing). U.S. Pat. No. 4,665,996, herein incorporated by reference in its entirety, discloses the use of hardfacing applied to the principal bearing surface of a drill pipe, with an alloy having the composition of: 50-65% cobalt, 25-35% molybdenum, 1-18% chromium, 2-10% silicon and less than 0.1% carbon for reducing the friction between a string and the casing or rock. As a result, the torque needed for the rotary drilling operation, especially directional drilling, is decreased. The disclosed alloy also provides excellent wear resistance on the drill string while reducing the wear on the well casing. Another form of hardbanding is WC-cobalt cermets applied to the drill stem assembly. Other hardbanding materials include TiC, Cr-carbide, and other mixed carbide and nitride systems. A tungsten carbide containing alloy, such as Stellite 6 and Stellite 12 (trademark of Cabot Corporation), has excellent wear resistance as a hardfacing material but may cause excessive abrading of the opposing device. Hardbanding may be applied to portions of the drill stem assembly using weld overlay or thermal spray methods. In a drilling operation, the drill stem assembly, which has a tendency to rest on the well casing, continually abrades the well casing as the drill string rotates.

There are many additional pieces of equipment that have metal-to-metal contact on a drilling rig that are subject to friction, wear, erosion, corrosion, and/or deposits. These devices include but are not limited to the following list: valves, pistons, cylinders, and bearings in pumping equipment; wheels, skid beams, skid pads, skid jacks, and pallets for moving the drilling rig and drilling materials and equipment; topdrive and hoisting equipment; mixers, paddles, compressors, blades, and turbines; and bearings of rotating equipment and bearings of roller cone bits.

Certain operations other than hole-making are often conducted during the drilling process, including logging of the open-hole (or of the cased-hole section) to evaluate formation properties, coring to remove portions of the formation for scientific evaluation, capture of formation fluids at downhole conditions for fluids analyses, placing tools against the wellbore to record acoustic signals, and other operations and methods known to those skilled in the art.

Marine Riser Systems:

In a marine environment, a further complication is that the wellhead tree may be "dry" (located above sea level on the platform) or "wet" (located on the seafloor). In either case, conductor pipes known as "risers" are placed between the surface and seafloor, with drill stem equipment run internal to the riser and with drilling fluid returns in the annular space. Risers may be particularly susceptible to the issues associated with rotating an inner pipe within an outer stationary pipe since the risers are not fixed but may also move due to contact with not only the drill string but also the sea environment. Drag and vortex shedding of a marine riser causes loads and vibrations that are due in part to frictional resistance of the ocean current around the outer surface of the marine riser.

Tubular Goods:

Oil-country tubular goods (OCTG) comprise drill stem equipment, casing, tubing, work strings, coiled tubing, and risers. Common to most OCTG (but not coiled tubing) are threaded connections, which are subject to potential failure resulting from improper thread and/or seal interference, leading to galling in the mating connectors that can inhibit use or reuse of the entire joint of pipe due to a damaged connection. Threads may be shot-peened, cold-rolled, and/or chemically treated (e.g., phosphate, copper plating, etc.) to improve their anti-galling properties, and application of an appropriate pipe thread compound provides benefits to connection usage. However, there are still problems today with thread galling and interference issues, particularly with the more costly OCTG material alloys for extreme service requirements.

Wellhead, Trees, and Valves:

At the top of the casing, the fluids are contained by wellhead equipment, which typically includes multiple valves and blowout preventers (BOP) of various types. Subsurface safety valves are critical pieces of equipment that must function properly in the event of an emergency or upset condition. Subsurface safety valves are installed downhole, usually in the tubing string, and may be closed to prevent flow from the subsurface. Chokes and flowlines connected to the wellhead (particularly joints and elbows) are subject to friction, wear, corrosion, erosion, and deposits. Chokes may be cut out by sand flowback, for example, rendering the measurement of flow rates inaccurate.

Many of these devices rely on seals and very close mechanical tolerances, including both metal-to-metal and elastomeric seals. Many devices (sleeves, pockets, nipples, needles, gates, balls, plugs, crossovers, couplings, packers, stuffing boxes, valve stems, centrifuges, etc.) are subject to friction and mechanical degradation due to corrosion and erosion, and even potential blockage resulting from deposits of scale, asphaltenes, paraffins, and hydrates. Some of these devices may be installed downhole or on the sea floor, and it may be impossible or very costly at best to gain service access for repair or restoration.

Completion Strings and Equipment:

With the drill well cased to prevent hole collapse and uncontrolled fluid flow, the completion operation must be performed to make the well ready for production. This operation involves running equipment into and out of the wellbore to perform certain operations such as cementing, perforating, stimulating, and logging. Two common means of conveyance of completion equipment are wireline and pipe (drill pipe, coiled tubing, or tubing work strings). These operations may include running logging tools to record formation and fluid properties, perforating guns to make holes in the casing to allow hydrocarbon production or fluid injection, temporary or permanent plugs to isolate fluid pressure, packers to facilitate setting pipe to provide a seal between the pipe interior and annular areas, and additional types of equipment needed for cementing, stimulating, and completing a well. Wireline tools and work strings may include packers, straddle packers, and casing patches, in addition to packer setting tools, devices to install valves and instruments in sidepockets, and other types of equipment to perform a downhole operation. The placement of these tools, particularly in extended-reach wells, may be impeded by friction drag. The final completion string left in the hole for production is commonly referred to as the production tubing string.

Formation and Sandface Completions:

In many wells, there is a tendency for sand or formation material to flow into the wellbore. To prevent this from occurring, "sand screens" are placed in the well across the completion interval. This operation may involve deploying a special-purpose large diameter assembly comprising one of several types of sand screen mesh designs over a central "base pipe." The screen and basepipe are frequently subject to erosion and corrosion and may fail due to sand "cutout." Also, in high inclination wells, the frictional drag resistance encountered while running screens into the wellbore may be excessive and limit the application of these devices, or the length of the wellbore may be limited by the maximum depth to which screen running operations may be conducted due to friction resistance.

In those wells that require sand control, a sand-like propping material, "proppant," is pumped in the annular area between the screen and formation to prevent the formation grains from flowing through the screens. This operation is called a "gravel pack" or, if conducted at fracturing conditions, may be called a "frac pack." In many other formations, often in wellbores without sand screens, fracture stimulation treatments may be conducted in which this same or different type of propping material is injected at fracturing conditions to create large propped fracture wings extending a significant distance away from the wellbore to increase the production or injection rate. Frictional resistance occurs while pumping the treatment as the proppant particles contact each other and the constraining walls. Furthermore, the proppant particles are subject to crushing and generating "fines" that increase the resistance to fluid flow during production. The proppant properties, including the strength, friction coefficient, shape, and roughness of the grain, are important to the successful execution of this treatment and the ultimate increase in well productivity or injectivity.

Artificial Lift Equipment:

When production from a well is initiated, it may flow at satisfactory rates under its own pressure. However, many wells at some point in their life require assistance in lifting fluids out of the wellbore. Many methods are used to lift fluids from a well, including: sucker rod, Corod™, and electric submersible pumps to remove fluids from the well, plunger lifts to displace liquids from a predominantly gas well, and "gas lift" or injection of a gas along the tubing to reduce the density of a liquid column. Alternatively, specialty chemicals may be injected through valves spaced along the tubing to prevent buildup of scale, asphaltene, paraffin, or hydrate deposits.

The production tubing string may include devices to assist fluid flow. Several of these devices may rely on seals and very close mechanical tolerances, including both metal-to-metal and elastomeric seals. Interfaces between parts (sleeves, pockets, plugs, packers, crossovers, couplings, bores, mandrels, etc.) are subject to friction and mechanical degradation due to corrosion and erosion, and even potential blockage or mechanical fit interference resulting from deposits of scale, asphaltenes, paraffins, and hydrates. In particular, gas lift, submersible pumps, and other artificial lift equipment may include valves, seals, rotors, stators, and other devices that may fail to operate properly due to friction, wear, corrosion, erosion, or deposits.

Well Intervention Equipment:

Downhole operations on a wellbore near the reservoir formation interval are often required to gather data or to initiate, restore, or increase production or injection rate. These operations involve running equipment into and out of the wellbore. Two common means of conveyance of completion equipment and tools are wireline and pipe. These operations may include running logging tools to record formation and fluid properties, perforating guns to make holes in the casing to allow hydrocarbon production or fluid injection, temporary permanent plugs to isolate fluid pressure, packers to facilitate a seal between intervals of the completion, and additional types of highly specialized equipment. The operation of running equipment into and out of a well involves sliding contact due to the relative motion of two bodies, thus creating frictional drag resistance.

Therefore, given the expansive nature of these broad requirements for production operations, there is a need for new coating material technologies that protect devices from friction, wear, corrosion, erosion, and deposits resulting from sliding contact between two or more devices and fluid flowstreams that may contain solid particles traveling at high velocities. This need requires novel materials that combine high hardness with a capability for low coefficient of friction (COF) when in contact with an opposing surface. If such coating material can also provide a low energy surface and low friction coefficient against the borehole wall, then this novel material coating may enable ultra-extended reach drilling, reliable and efficient operations in difficult environments, including offshore and deepwater applications, and generate cost reduction, safety, and operational improvements throughout oil and gas well production operations. As envisioned, the use of these coatings on well production devices could have widespread application and provide significant improvements and extensions to well production operations.

SUMMARY

According to the present disclosure, an advantageous coated oil and gas well production device comprises: one or more cylindrical bodies, and a coating on at least a portion of the one or more cylindrical bodies, wherein the coating is chosen from an amorphous alloy, a heat-treated electroless or electro plated based nickel-phosphorous composite with a phosphorous content greater than 12 wt %, graphite, $MoS_2$, $WS_2$, a fullerene based composite, a boride based cermet, a quasicrystalline material, a diamond based material, diamond-like-carbon (DLC), boron nitride, and combinations thereof.

A further aspect of the present disclosure relates to an advantageous coated oil and gas well production device comprising: an oil and gas well production device including one or more bodies with the proviso that the one or more bodies does not include a drill bit, and a coating on at least a portion of the one or more bodies, wherein the coating is chosen from an amorphous alloy, a heat-treated electroless or electro plated based nickel-phosphorous based composite with a phosphorous content greater than 12 wt %, graphite, $MoS_2$, $WS_2$, a fullerene based composite, a boride based cermet, a quasicrystalline material, a diamond based material, diamond-like-carbon (DLC), boron nitride, and combinations thereof.

A still further aspect of the present disclosure relates to an advantageous method for coating an oil and gas well production device comprising: providing a coated oil and gas well production device comprising an oil and gas well production device including one or more cylindrical bodies, and a coating on at least a portion of the one or more cylindrical bodies, wherein the coating is chosen from an amorphous alloy, a heat-treated electroless or electro plated based nickel-phosphorous composite with a phosphorous content greater than 12 wt %, graphite, $MoS_2$, $WS_2$, a fullerene based composite, a boride based cermet, a quasicrystalline material, a diamond based material, diamond-like-carbon (DLC), boron nitride, and combinations thereof, and utilizing the coated oil and gas well production device in well construction, completion, or production operations.

A still yet further aspect of the present disclosure relates to an advantageous method for coating an oil and gas well production device comprising: providing an oil and gas well production device including one or more bodies with the proviso that the one or more bodies does not include a drill bit, and a coating on at least a portion of the one or more bodies, wherein the coating is chosen from an amorphous alloy, a heat-treated electroless or electro plated based nickel-phosphorous composite with a phosphorous content greater than 12 wt %, graphite, $MoS_2$, $WS_2$, a fullerene based composite, a boride based cermet, a quasicrystalline material, a diamond based material, diamond-like-carbon (DLC), boron nitride, and combinations thereof, and utilizing the coated oil and gas well production device in well construction, completion, or production operations.

These and other features and attributes of the disclosed coated oil and gas well production devices, methods for coating such devices for reducing friction, wear, corrosion, erosion, and deposits in such application areas, and their advantageous applications and/or uses will be apparent from the detailed to description which follows, particularly when read in conjunction with the figures appended hereto.

BRIEF DESCRIPTION OF DRAWINGS

To assist those of ordinary skill in the relevant art in making and using the subject matter hereof, reference is made to the appended drawings, wherein:

FIG. 2 depicts exemplary application of a coating applied to a drill stem assembly for subterreaneous drilling applications.

FIG. 3 depicts exemplary application of coatings applied to bottomhole assembly devices, in this case reamers, stabilizers, mills, and hole openers.

FIG. 5 depicts exemplary application of a coating applied to polished rods, sucker rods, and pumps used in downhole pumping operations.

FIG. 6 depicts exemplary application of a coating applied to perforating guns, packers, and logging tools.

FIG. 12 depicts exemplary application of a coating applied to prevent deposition of a scale deposit.

FIG. 13 depicts exemplary application of a coating applied to a threaded connection and illustrates thread galling.

DEFINITIONS

Figure 1:
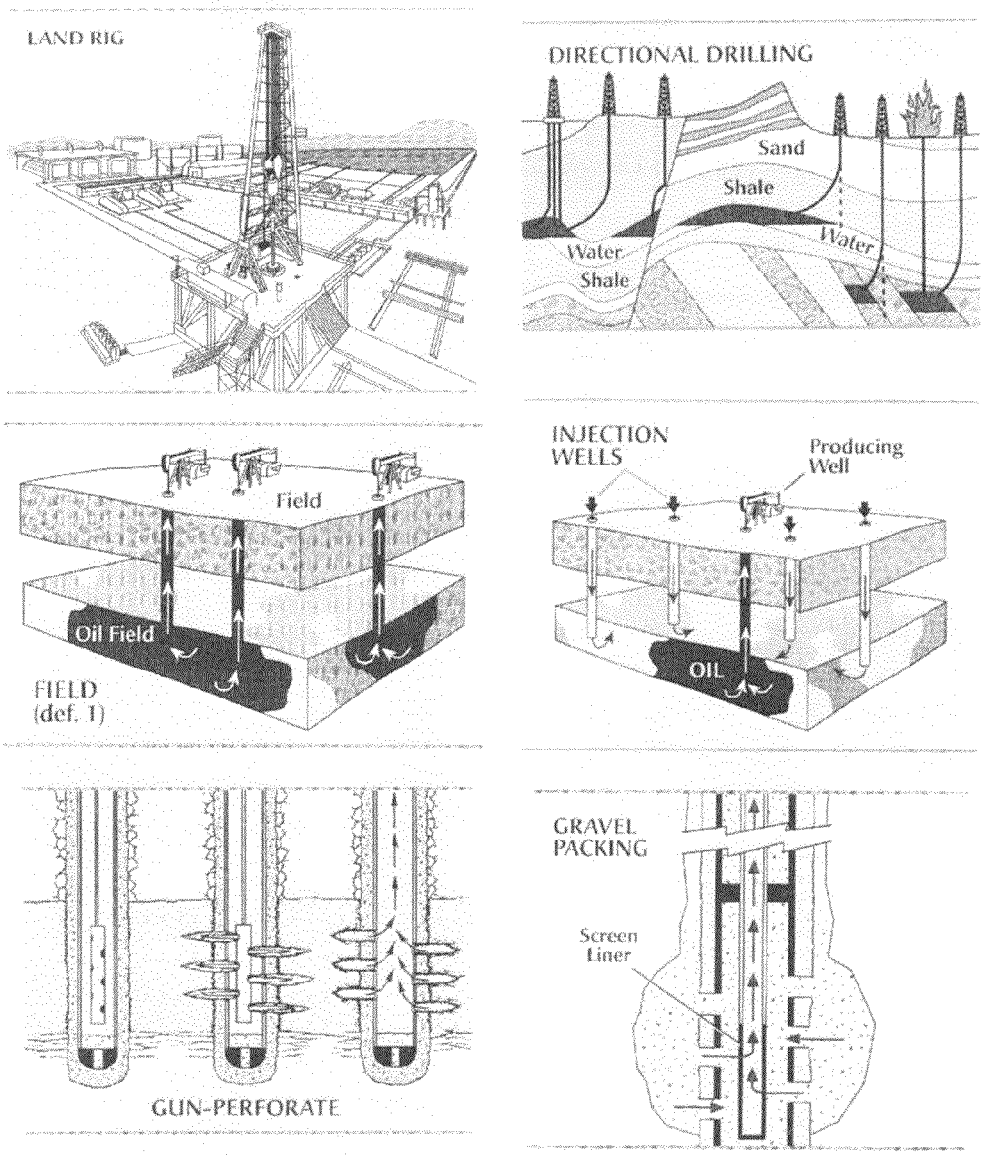
FIG. 1 depicts an oil and gas well production system that employs well production devices in the individual well construction, completion, stimulation, workover, and production phases of the overall production process.

"Annular isolation valve" is a valve at the surface to control flow from the annular space between casing and tubing.

"Asphaltenes" are heavy hydrocarbon chains that may be deposited on the walls of pipes and other flow equipment and therefore create a flow restriction.

"Basepipe" is a liner that serves as the load-bearing device of a sand control screen. The screens are attached to the outside of the basepipe. At least a portion of the basepipe may be pre-perforated, slotted, or equipped with an inflow control device. The basepipe is fabricated in jointed sections that are threaded for makeup while running in hole.

"Bearings and bushings" are used to provide a low friction surface for two devices to move relative to each other in sliding contact, especially to allow relative rotational motion.

"Blast joints" are thicker-walled pipe used across flowing perforations or in a wellhead across a fluid inlet during a stimulation treatment. The greater wall thickness and/or material hardness resists being completely eroded through due to sand or proppant impingement.

"Bottom hole assembly" (BHA) is comprised of one or more devices, including but not limited to: stabilizers, variable-gauge stabilizers, back reamers, drill collars, flex drill collars, rotary steerable tools, roller reamers, shock subs, mud motors, logging while drilling (LWD) tools, measuring while drilling (MWD) tools, coring tools, under-reamers, hole openers, centralizers, turbines, bent housings, bent motors, drilling jars, acceleration jars, crossover subs, bumper jars, torque reduction tools, float subs, fishing tools, fishing jars, washover pipe, logging tools, survey tool subs, non-magnetic counterparts of any of these devices, and combinations thereof and their associated external connections.

"Casing" is pipe installed in a wellbore to prevent the hole from collapsing and to enable drilling to continue below the bottom of the casing string with higher fluid density and without fluid flow into the cased formation. Typically, multiple casing strings are installed in the wellbore of progressively smaller diameter.

"Casing centralizers" are banded to the outside of casing as it is being run in hole. Centralizers are often equipped with steel springs or metal fingers that push against the formation to achieve standoff from the formation wall, with an objective to centralize the casing to provide a more uniform annular space around the casing to achieve a better cement seal. Centralizers may include finger-like devices to scrape the wellbore to dislodge drilling fluid filtercake that may inhibit direct cement contact with the formation.

"Casing-while-drilling" refers to a relatively new and unusual method to drill using the casing instead of a removable drill string. When the hole section has reached depth, the casing is left in position, an operation is performed to remove or displace the cutting elements at the bottom of the casing, and a cement job may then be pumped.

"Chemical injection system" is used to inject chemical inhibitors into the wellbore to prevent buildup of scale, methane hydrates, or other deposits in the wellbore that would restrict production.

"Choke" is a device to restrict the rate of flow. Wells are commonly tested on a specific choke size, which may be as simple as a plate with a hole of specified diameter. When sand or proppant flow through a choke, the hole may be eroded and the choke size may change, rendering inaccurate flow rate measurements.

"Coaxial" refers to two or more objects having axes which are substantially identical or along the same line. "Non-coaxial" refers to objects which have axes that may be offset but substantially parallel or may otherwise not be along the same line.

"Completion sliding sleeves" are devices that are installed in the completion string that selectively enable orifices to be opened or closed, allowing productive intervals to be put into communication with the tubing or not, depending on the state of the sleeve. In long term use, the success of operating sliding sleeves depends on the resistance to operating the sleeve due to friction, to wear, deposits, erosion, and corrosion.

"Complex geometry" refers to an object that is not substantially comprised of a single primitive geometry such as a sphere, cylinder, or cube. Complex geometries may be comprised of multiple simple geometries, such as a cylinder, cube, or sphere with many different radii, or may be comprised of simple primitives and other complex geometries.

"Connection pin" is a piece of pipe with the threads on the external surface of the pipe.

"Connection box" is a piece of pipe with the threads on the internal surface of the pipe.

"Contact rings" are devices attached to components of logging tools to achieve standoff of the tool from the wall of the casing or formation. For example, contact rings may be installed at joints in a perforating gun to achieve a standoff of the gun from the casing wall, for example in applications such as "Just-In-Time Perforating" (PCT Application No. WO2002/103161A2).

"Contiguous" refers to objects which are adjacent to one another such that they may share a common edge or face. "Non-contiguous" refers to objects that do not have a common edge or face because they are offset or displaced from one another. For example, tool joints are larger diameter cylinders that are non-contiguous because a smaller diameter cylinder, the drill pipe, is positioned between the tool joints.

"Control lines" and "conduits" are small diameter tubing that may be run external to a tubing string to provide hydraulic pressure, electrical voltage or current, or a fiberoptic path, to one or more downhole devices. Control lines are used to operate subsurface safety values, chokes, and valves. An injection line is similar to a control line and may be used to inject a specialty chemical to a downhole valve for the purpose of inhibition of scale, asphaltene, paraffin, or hydrate formation, or for friction reduction.

"Corod™" is a continuous coiled tubular used as a sucker rod in rod pumping production operations.

"Cylinder" is (1) a surface or solid bounded by two parallel planes and generated by a straight line moving parallel to the given planes and tracing a curve bounded by the planes and lying in a plane perpendicular or oblique to the given planes, and/or (2) any cylinderlike object or part, whether solid or hollow (source: www.dictionary.com).

"Downhole tools" are devices that are often run retrievably into a well, or possibly fixed in a well, to perform some function in the wellbore. Some downhole tools may be run on a drill stem, such as Measurement While Drilling (MWD) devices, whereas other downhole tools may be run on wireline, such as formation logging tools or perforating guns. Some tools may be run on either wireline or pipe. A packer is a downhole tool that may be run on pipe or wireline to be set in the wellbore to block flow, and it may be removable or fixed. There are many downhole tool devices that are commonly used in the industry.

"Drill collars" are heavy wall pipe in the bottom hole assembly near the bit. The stiffness of the drill collars help the bit to drill straight, and the weight of the collars are used to apply weight to the bit to drill forward.

"Drill stem" is defined as the entire length of tubular pipes, composed of the kelly (if present), the drill pipe, and drill collars, that make up the drilling assembly from the surface to the bottom of the hole. The drill stem does not include the drill bit. In the special case of casing-while-drilling operations, the casing string that is used to drill into the earth formations will be considered part of the drill stem.

"Drill stem assembly" is defined as a combination of a drill string and bottom hole assembly or coiled tubing and bottom hole assembly. The drill stem assembly does not include the drill bit.

"Drill string" is defined as the column, or string of drill pipe with attached tool joints, transition pipe between the drill string and bottom hole assembly including tool joints, heavy weight drill pipe including tool joints and wear pads that transmits fluid and rotational power from the top drive or kelly to the drill collars and the bit. In some references, but not in this document, the term "drill string" includes both the drill pipe and the drill collars in the bottomhole assembly.

"Elastomeric seal" is used to provide a barrier between two devices, usually metal, to prevent flow from one side of the seal to the other. The elastomeric seal is chosen from one of a class of materials that are elastic or resilient.

"Elbows, tees, and couplings" are commonly used pipe equipment for the purpose of connecting flowlines to complete a flowpath for fluids, for example to connect a wellbore to surface production facilities.

"Expandable tubulars" are tubular goods such as casing strings and liners that are slightly undergauge while running in hole. Once in position, a larger diameter tool, or expansion mandrel, is forced down the expandable tubular to deform it to a larger diameter.

"Gas lift" is a method to increase the flow of hydrocarbons in a wellbore by injecting gas into the tubing string through gas lift valves. This process is usually applied to oil wells, but could be applied to gas wells with high fractions of water production. The added gas reduces the hydrostatic head of the fluid column.

"Glass fibers" are often run in small control lines, both downhole and return to surface, for the measurement of downhole properties, such as temperature or pressure. Glass fibers may be used to provide continuous readings at fine spatial samplings along the wellbore. The fiber is often pumped down one control line, through a "turnaround sub," and up a second control line. Friction and resistance passing through the turnaround sub may limit some fiberoptic installations.

"Inflow control device" (ICD) is an adjustable orifice, nozzle, or flow channel in the completion string across the formation interval to enable the rate of flow of produced fluids into the wellbore. This may be used in conjunction with additional measurements and automation in a "smart" well completion system.

"Jar" is a downhole tool that is used to apply a large axial load, or shock, when triggered by the operator. Some jars are fired by setting weight down, and others are fired when pulled up. The firing of the jar is usually done to move pipe that has become stuck in the wellbore.

"Kelly" is a flat-sided polygonal piece of pipe that passes through the drilling rig floor on rigs equipped with older rotary table equipment. Torque is applied to this four-, six-, or perhaps eight-sided piece of pipe to rotate the drill pipe that is connected below.

"Logging tools" are instruments that are typically run in a well to make measurements, for example during drilling on the drill stem or in open or cased hole on wireline. The instruments are installed in a series of carriers configured to run into a well, such as cylindrical-shaped devices, that provide environmental isolation for the instruments.

"Makeup" is the process of screwing together the pin and box of a pipe connection to effect a joining of two pieces of pipe and to make a seal between the inner and outer portions of the pipe.

"Mandrel" is a cylindrical bar or shaft that fits within an outer cylinder. A mandrel may be the main actuator in a packer that causes the gripping units, or "slips," to move outward to contact the casing. The term mandrel may also refer to the tool that is forced down an expandable tubular to deform it to a larger diameter. Mandrel is a generic term used in several types of oilfield devices.

"Metal mesh" for a sand control screen is comprised of woven metal filaments that are sized and spaced in accordance with the corresponding formation sand grain size distribution. The screen material is generally corrosion resistant alloy (CRA) or carbon steel.

"Mazeflo™" completion screens are sand screens with redundant sand control and baffled compartments. MazeFlo self-mitigates any mechanical failure of the screen to the local compartment maze, while allowing continued hydrocarbon flow through the undamaged sections. The flow paths are offset so that the flow makes turns to redistribute the incoming flow momentum (for example, refer to U.S. Pat. No. 7,464,752).

"Moyno™ pumps" and "progressive cavity pumps" are long cylindrical pumps installed in downhole motors that generate rotary torque in a shaft as the fluid flows between the external stator and the rotor attached to the shaft. There is usually one more lobe on the stator than the rotor, so the force of the fluid traveling to the bit forces the rotor to turn. These motors are often installed close to the bit. Alternatively, in a downhole pumping device, power can be applied to turn the rotor and thereby pump fluid.

"Packer" is a tool that may be placed in a well on a work string, coiled tubing, production string, or wireline. Packers provide fluid pressure isolation of the regions above and below the packer. In addition to providing a hydraulic seal that must be durable and withstand severe environmental conditions, the packer must also resist the axial loads that develop due to the fluid pressure differential above and below the packer.

"Packer latching mechanism" is used to operate a packer, to make it release and engage the slips by axial movement of the pipe to which it is connected. When engaged, the slips are forced outwards into the casing wall, and the teeth of the slips are pressed into the casing material with large forces. A wireline packer is run with a packer setting tool that pulls the mandrel to engage the slips, after which the packer setting tool is disengaged from the packer and retrieved to the surface.

"MP35N" is a metal alloy consisting primarily of nickel, cobalt, chromium, and molybdenum. MP35N is considered highly corrosion resistant and suitable for hostile downhole environments.

"Paraffin" is a waxy component of some crude hydrocarbons that may be deposited on the walls of wellbores and flowlines and thereby cause flow restrictions.

"Pistons" and "piston liners" are cylinders that are used in pumps to displace fluids from an inlet to an outlet with corresponding fluid pressure increase. The liner is the sleeve within which the piston reciprocates. These pistons are similar to the pistons found in the engine of a car.

"Plunger lift" is a device that moves up and down a tubing string to purge the tubing of water, similar to a pipeline "pigging" operation. With the plunger lift at the bottom of the tubing, the pig device is configured to block fluid flow, and therefore it is pushed uphole by fluid pressure from below. As it moves up the wellbore it displaces water because the water is not allowed to separate and flow past the plunger lift. At the top of the tubing, a device triggers a change in the plunger lift configuration such that it now bypasses fluids, whereupon gravity pulls it down the tubing against the upwards flowstream. Friction and wear are important parameters in plunger lift operation. Friction reduces the speed of the plunger lift falling or rising, and wear of the outer surface provides a gap that reduces the effectiveness of the device when traveling uphole.

"Production device" is a broad term defined to include any device related to the drilling, completion, stimulation, workover, or production of an oil and/or gas well. A production device includes any device described herein used for the purpose of oil or gas production. For convenience of terminology, injection of fluids into a well is defined to be production at a negative rate. Therefore, references to the word "production" will include "injection" unless stated otherwise.

"Reciprocating seal assembly" is a seal that is designed to maintain pressure isolation while two devices are displaced axially.

"Roller cone bit" is an earth-boring device equipped with conical shaped cutting elements, usually three, to make a hole in the ground.

"Rotating seal assembly" is a seal that is designed to maintain pressure isolation while two devices are displaced in rotation.

"Sand probe" is a small device inserted into a flowstream to assess the amount of sand content in the stream. If the sand content is high, the sand probe may be eroded.

"Scale" is a deposit of minerals (e.g. calcium carbonate) on the walls of pipes and other flow equipment that may build up and cause a flow restriction.

"Service tools" for gravel pack operations include a packer crossover tool and tailpipe to circulate down the workstring, around the liner and tailpipe, and back to the annulus. This permits placement of slurry opposite the formation interval. More generally, the gravel pack service tool is a group of tools that carry to the gravel pack screens to TD, sets and tests the packer, and controls the flow path of the fluids pumped during gravel pack operations. The service tool includes the setting tool, the crossover, and the seals that seal into a packer bore. It can include an anti-swab device and a fluid loss or reversing valve.

"Shock sub" is a modified drill collar that has a shock absorbing spring-like element to provide relative axial motion between the two ends of the shock sub. A shock sub is sometimes used for drilling very hard formations in which high levels of axial shocks may occur.

"Shunt tubes" are external or internal tubes run in a sand control screen to divert the gravel pack slurry flow over long or multi-zone completion intervals until a complete gravel pack is achieved. See, for example, U.S. Pat. Nos. 4,945,991, 5,113,935, and PCT Patent Publication Nos. WO2007/092082, WO2007/092083, WO2007/126496, and WO2008/060479.

"Sidepocket" is an offset heavy-wall sub in the tubing for placing gas lift valves, temperature and pressure probes, injection line valves, etc.

"Sliding contact" refers to frictional contact between two bodies in relative motion, whether separated by fluids or solids, the latter including particles in fluid (bentonite, glass beads, etc) or devices designed to cause rolling to mitigate friction. A portion of the contact surface of two bodies in relative motion will always be in a state of slip, and thus sliding.

"Smart well" is a well equipped with devices, instrumentation, and controls to enable selective flow from specified intervals to maximize production of desirable fluids and minimize production of undesirable fluids. The flow rates may be adjusted for additional reasons, such as to control the drawdown or pressure differential for geomechanics reasons.

"Stimulation treatment" lines are pipe used to connect pumping equipment to the wellhead for the purpose of conducting a stimulation treatment.

"Subsurface safety valve" is a valve installed in the tubing, often below the seafloor in an offshore operation, to shut off flow. Sometimes these valves are set to automatically close if the rate exceeds a set value, for instance if containment was lost at the surface.

"Sucker rods" are steel rods that connect a beam-pumping unit at the surface with a sucker-rod pump at the bottom of a well. These rods may be jointed and threaded or they may be continuous rods that are handled like coiled tubing. As the rods reciprocate up and down, there is friction and wear at the locations of contact between the rod and tubing.

"Surface flowlines" are pipe used to connect the wellhead to production facilities, or alternatively, for discharge of fluid to the pits or flare stack.

"Threaded connection" is a means to connect pipe sections and achieve a hydraulic seal by mechanical interference between interlaced threaded, or machined (e.g., metal-to-metal seal), parts. A threaded connection is made up, or assembled, by rotating one device relative to another. Two pieces of pipe may be adapted to thread together directly, or a connector piece referred to as a coupling may be screwed onto one pipe, followed by screwing a second pipe into the coupling.

"Top drive" is a method and equipment used to rotate the drill pipe from a drive system located on a trolley that moves up and down rails attached to the drilling rig mast. Top drive is the preferred means of operating drill pipe because it facilitates simultaneous rotation and reciprocation of pipe and circulation of drilling fluid. In directional drilling operations, there is often less risk of sticking the pipe when using top drive equipment.

"Tubing" is pipe installed in a well inside casing to allow fluid flow to the surface.

"Valve" is a device that is used to control the rate of flow in a flowline. There are many types of valve devices, including check valve, gate valve, globe valve, ball valve, needle valve, and plug valve. Valves may be operated manually, remotely, or automatically, or a combination thereof. Valve performance is highly dependent on the seal established between close-fitting mechanical devices.

"Valve seat" is the static surface upon which the dynamic seal rests when the valve is operated to prevent flow through the valve. For example, a flapper of a subsurface safety valve will seal against the valve seat when it is closed.

"Wash pipe" in a sand control operation is a smaller diameter pipe that is run inside the basepipe after the screens are placed in position across the formation interval. The wash pipe is used to facilitate annular slurry flow across the entire completion interval, take the return flow during the gravel packing treatment, and leave gravel pack in the screen-wellbore annulus.

"Wireline" is a cable that is used to run tools and devices in a wellbore. Wireline is often comprised of many smaller strands twisted together, but monofilament wireline, or "slick line," also exists. Wireline is usually deployed on large drums mounted on logging trucks or skid units.

"Work strings" are jointed pieces of pipe used to perform a wellbore operation, such as running a logging tool, fishing materials out of the wellbore, or performing a cement squeeze job.

(Note: Several of the above definitions are from *A Dictionary for the Petroleum Industry*, Third Edition, The University of Texas at Austin, Petroleum Extension Service, 2001.)

DETAILED DESCRIPTION

All numerical values within the detailed description and the claims herein are modified by "about" or "approximately" the indicated value, and take into account experimental error and variations that would be expected by a person having ordinary skill in the art.

Disclosed herein are coated oil and gas well production devices and methods of making and using such coated devices. The coatings described herein provide significant performance improvement of the various oil and gas well devices and operations disclosed herein. FIG. 1 illustrates the overall oil and gas well production system, for which the application of coatings to certain production devices as described herein may provide improved performance of these devices. FIG. 1A is a schematic of a land based drilling rig 10. FIG. 1B is a schematic of drilling rigs 10 drilling directionally through sand 12, shale 14, and water 16 into oil fields 18. FIGS. 1C and 1D are schematics of producing wells 20 and injection wells 22. FIG. 1E is a schematic of a perforating gun 24. FIG. 1F is a schematic of gravel packing 26 and screen liner 28. With no loss of generality, different inventive coatings may be preferred for different well production devices. A broad overview of production operations in its entirety shows the extent of the possible field applications for these coatings.

The method of coating such devices disclosed herein includes applying a suitable coating to a portion of at least one device that will be subject to friction, wear, corrosion, erosion, and/or deposits. A coating is applied to at least a portion of the surface of at least one device that is exposed to contact with another solid or with a fluid flowstream, wherein: the coefficient of friction of the coating is less than or equal to 0.15; the hardness of the coating is greater than 400 VHN; the wear resistance of the coated device is at least 3 times that of the uncoated device; and/or the surface energy of the coating is less than 1 $J/m^2$. There is art to choosing the appropriate coating from the coatings disclosed herein, the specific application method, and the selection of the surfaces to be coated to maximize the technical and economic advantages of this technology for each specific application. However, there are common elements among these diverse application areas that provide a unifying theme to the coating methods and applications. Specific oilfield equipment device modifications have been conceived to take advantage of this method and are included in the invention.

U.S. Provisional Patent Application No. 61/189,530 filed on Aug. 20, 2008, herein incorporated by reference in its entirety, discloses the use of ultra-low friction coatings on drill stem assemblies used in gas and oil drilling applications. Other oil and gas well production devices may benefit from the use of the coatings disclosed herein. A drill stem assembly is one example of a production device that may benefit from the use of coatings. The geometry of an operating drill stem assembly is one example of a class of applications comprising a cylindrical body. In the case of the drill stem, the actual drill stem assembly is an inner cylinder that is in sliding contact with the casing or open hole, an outer cylinder. These devices may have varying radii and alternatively may be described as comprising multiple contiguous cylinders of varying radii. As described below, there are several other instances of cylindrical bodies in oil and gas well production operations, either in sliding contact due to relative motion or stationary subject to contact by fluid flowstreams. The inventive coatings may be used advantageously for each of these applications by considering the relevant problem to be addressed, by evaluating the contact or flow problem to be solved to mitigate friction, wear, corrosion, erosion, or deposits, and by judicious consideration of how to apply such coatings to the specific devices for maximum utility and benefit.

There are many more examples of oil and gas well production devices that provide opportunities for beneficial use of coatings on portions of the surfaces of various bodies, as described in the background, including: stationary bodies coated for corrosion and erosion resistance and resistance to deposits on external or internal surfaces, or both; stationary devices coated for friction reduction and resistance to erosion and wear; threaded connections coated for make-up friction reduction, galling resistance, and metal-to-metal seal performance; and bearings, bushings, and other geometries coated for friction and wear reduction and for erosion, corrosion, and wear resistance.

In each case, there may be primary and secondary motivations for the use of coatings to mitigate friction, wear, corrosion, erosion, and deposits. Different portions of the same body may have different coatings applied to address different coatings design aspects, including the issue to be addressed, the technology available for application of the coatings, and the economics associated with each type of coating. There will likely be many tradeoffs and compromises that govern the ultimate selection of coating applications.

Overview of Use of Coatings and Associated Benefits:

In the wide range of operations and equipment that are required during the various stages of preparing for and producing hydrocarbons from a wellbore, there are several prototypical applications that appear in various contexts. These applications may be seen as various geometries of bodies in sliding contact and fluid flows interacting with the surfaces of solid objects. Several specific geometries and exemplary applications are enumerated below, but a person skilled in the art will understand the broad scope of the applications of coatings and this list does not limit the range of the inventive methods disclosed herein:

A. Coated Cylindrical Bodies in Sliding Contact Due to Relative Motion:

In an application that is ubiquitous throughout production operations, two cylindrical bodies are in contact, and friction and wear occur as one body moves relative to the other. The bodies may be comprised of multiple cylindrical sections that are placed contiguously with varying radii, and the cylinders may be placed coaxially or non-coaxially. Coating small areas of at least one of the cylindrical bodies, perhaps a removable part that may subsequently be serviced or replaced, may be desired. For example, coating portions of the tool joints of drill pipe may be an effective means to utilize coatings to reduce the contact friction between drill stem and casing or open-hole. In another application, for instance plunger lift devices, it may be advantageous to coat the entire surface area of the smaller object, the plunger lift device. In addition to friction reduction, wear performance may also be enhanced via the coatings disclosed herein. The coated cylindrical bodies in sliding contact relative motion also may exhibit improved hardness, which provides improved wear resistance.

An exemplary list of such applications is as follows:

Drill pipe may be picked up or slacked off causing longitudinal motion and may be rotated within casing or open hole. Friction forces and device wear increase as the well inclination increases, as the local wellbore curvature increases, and as the contact loads increase. These friction loads cause significant drilling torque and drag which must be overcome by the rig and drill string devices (see FIG. 2). FIG. 2A exhibits deflection occurring in a drill string assembly 30 in a directional or horizontal well. FIG. 2B is a schematic of a drill pipe 32 and a tool joint 34, with threaded connection 35. FIG. 2C is a schematic of a bit and bottom hole assembly 36. FIG. 2 D is a schematic of a casing 38 and a tool joint 39 to show the contact that occurs between the two and how the friction reducing coatings disclosed herein may be used to reduce the friction between the two components as the tool joint 39 rotates within the casing 38. The low-friction coatings disclosed herein will reduce the torque required to turn the tool joint 39 within the casing 38 for drilling of lateral wells. The coatings may also be used in the pipe threaded connections 35.

Bottomhole assembly (BHA) devices are located below the drill pipe on the drill stem assembly and may be subjected to similar friction and wear, and thus the coatings disclosed herein may provide a reduction in these mechanical problems (see FIG. 3). In particular, the coatings disclosed herein applied to the BHA devices may reduce friction and wear at contact points with the open hole and lengthen the tool life. Low surface energy of the coatings disclosed herein may also inhibit sticking of formation cuttings to the tools and corrosion and erosion limits may also be extended. It may also reduce the tendency for differential sticking. FIG. 3A is a schematic of mills 40 used in bottomhole assembly devices. FIG. 3B is a schematic of a bit 41 and a hole opener 42 used in bottomhole assembly devices. FIG. 3C is a schematic of a reamer 44 used in bottomhole assembly devices. FIG. 3D is a schematic of stabilizers 46 used in bottomhole assembly devices. FIG. 3E is a schematic of subs 48 used in bottomhole assembly devices.

Figure 4:
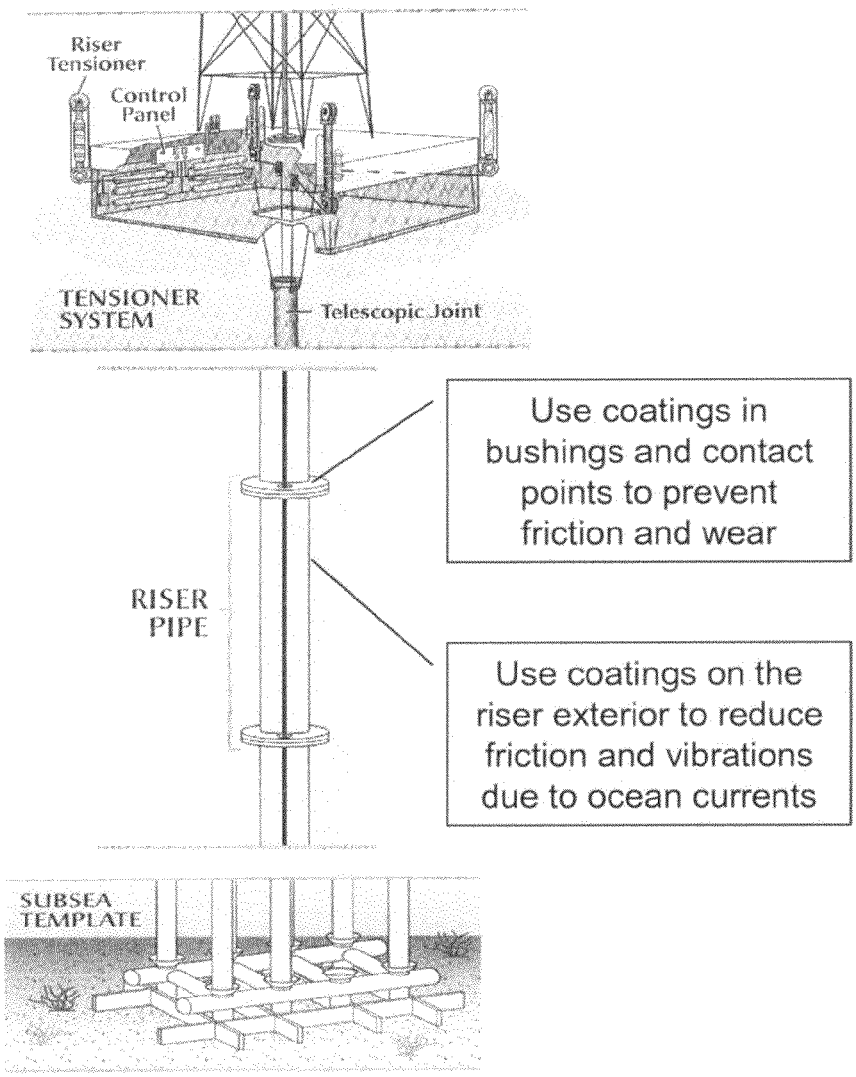
FIG. 4 depicts exemplary application of a coating applied to a marine riser system.

Drill strings are operated within marine riser systems and may cause wear to the riser as a result of the drilling operation. Use of coatings on wear pads and other devices within the riser and on tool joints on the drill string will reduce riser wear due to drilling (see FIG. 4). The vibrations of the riser due to ocean currents may be mitigated by coatings, and marine growth may also be inhibited, further reducing the drag associated with flowing currents. Referring to FIG. 4, use of the coatings disclosed herein on the riser pipe exterior 50 may be used to reduce friction and vibrations due to ocean currents.

In addition, the use of the coatings disclosed herein on internal bushings 52 and other contact points may be used to reduce friction and wear.

Plunger lifts remove water from a well by running up and down within a tubing string. Both the plunger lift outer diameter and the tubing inner diameter may be affected by wear, and the efficiency of the plunger lift decreases with wear and contact friction factor. Reducing friction will increase the maximum allowable deviation for plunger lift operation, increasing the range of applicability of this technology. Reducing the wear of both tubing and plunger lift will increase the time interval between required servicing. From an operations perspective, reducing the wear of the tubing inner diameter is highly desirable. Furthermore, coating the internal surface of a plunger lift may be beneficial. In the bypass state, fluid will flow through the tool more easily if the flow resistance is reduced by coatings on the internal portions of the tool, allowing the tool to drop faster.

Completion sliding sleeves may be moved axially, for example by stroking coiled tubing to displace the cylindrical sleeve up or down relative to the tool body that may also be cylindrical. These sleeves become susceptible to friction, wear, erosion, corrosion, and sticking due to damage from formation materials and buildup of scale and deposits.

Sucker rods and Corod™ tubulars are used in pumping jacks to pump oil to the surface in low pressure wells, and they may also be used to pump water out of gas wells. Friction and wear occur continuously as the rods move relative to the tubing string. A reduction in friction may enable selection of smaller pumping jacks and reduce the power requirements for well pumping operations (see FIG. 5). Referring to FIG. 5A, the coatings disclosed herein may be used on the contact points of rod pumping devices, including, but not limited to, the sucker rod guide 60, the sucker rod 62, the tubing packer 64, the downhole pump 66, and the perforations 68. Referring to FIG. 5B, the coatings disclosed herein may be used on polished rod clamp 70 and the polished rod 72 to provide smooth durable surfaces as well as good seals. FIG. 5C is a schematic of a sucker rod 62 wherein the coatings disclosed herein may be used to prevent friction and wear and on the threaded connections 74.

Pistons and/or piston liners in pumps for drilling fluids on drilling rigs and pumps for stimulation fluids in well stimulation activities may be coated to reduce friction and wear, enabling improved pump performance and longer device life. Since certain equipment is used to pump acid, the coatings may also reduce corrosion and possibly erosion damage to these devices.

Expandable tubulars are typically run in hole, supported with a hanging assembly, and then expanded by running a mandrel through the pipe. Coating the surface of the mandrel may greatly reduce the mandrel load and enable expandable tubular applications in higher inclination wells than would otherwise be possible. The speed and efficiency of the expansion operation may be improved by significant friction reduction. The mandrel is a tapered cylinder and may be considered to be comprised of contiguous cylinders of varying radii; alternatively, a tapered mandrel may be considered to have a complex geometry.

Control lines and conduits may be internally coated for reduced flow resistance and corrosion/erosion benefits. Glass filament fibers may be pumped down internally coated conduits and turnaround subs with reduced resistance.

Tools operated in wellbores are typically cylindrical bodies or bodies comprised of contiguous cylinders of varying radii that are operated in casing, tubing, and open hole, either on wireline or rigid pipe. Friction resistance increases as the wellbore inclination increases or local wellbore curvature increases, rendering operation of such tools to be unreliable on wireline. Coatings applied to the contact surfaces may enable such tools to be reliably operated on wireline at higher inclinations. A list of such tools includes but is not limited to: logging tools, perforating guns, and packers (see FIG. 6). Referring to FIG. 6A, the coatings disclosed herein may be used on the external surfaces of a caliper logging tool 80 to reduce friction and wear with the open hole 82 or casing (not shown). Referring to FIG. 6B, the coatings disclosed herein may be used on the external surfaces of an acoustic logging sonde 84, including, but not limited to, the signal transmitter 86 and signal receiver 88 to reduce friction and wear with the casing 90 or in open hole. Referring to FIGS. 6C and 6D, the coatings disclosed herein may be used on the external surfaces of packers 92 and perforating gun 94 to reduce friction and wear with the open hole. Low surface energy of the coatings will inhibit sticking of formation to the tools and corrosion and erosion limits may also be extended.

Coatings may be applied to the internal portions of critical pipe sections that are subject to high curvature and contact loads during drilling and other tool running operations. These coatings may be applied prior to running the casing into the wellbore or, alternatively, after the pipe is in position.

Figure 7:
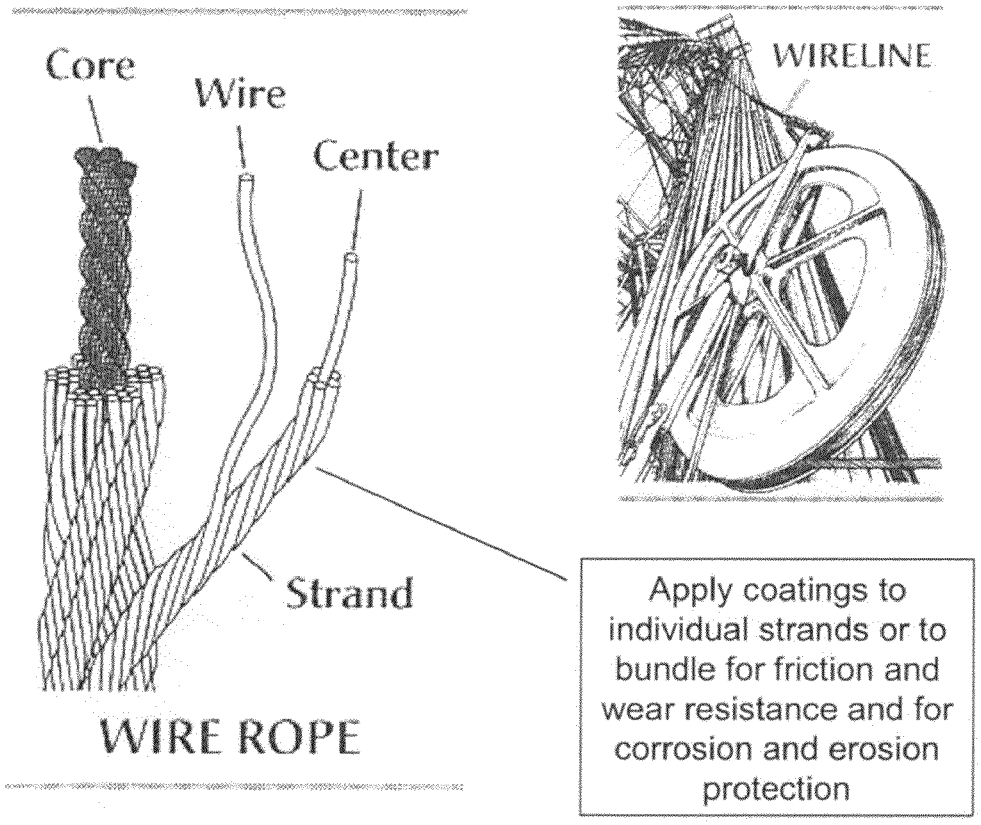
FIG. 7 depicts exemplary application of coatings applied to wire rope and wire line and bundles of stranded cables.

Wireline is a slender cylindrical body that is operated within casing, tubing, and open hole. At a higher level of detail, each strand is a cylinder, and the twisted strands are a bundle of non-coaxial cylinders that together comprise the effective cylinder of the wireline. Friction forces are present at the contact points between wireline and wellbore, and therefore coating the wireline with low-friction coatings will enable operation with reduced friction and wear. Braided line, multi-conductor, single conductor, and slickline may all be beneficially coated with low-friction coatings (see FIG. 7). Referring to FIG. 7A, the coatings disclosed herein may be applied the wire line 100 by application to the wire 102, the individual strands of wire 104 or to the bundle of strands 106. A pulley type device 108 as seen in FIG. 7B may be used to run logging tools conveyed by wireline 100 into casing, tubing and open hole. The pulley device may also use coatings advantageously in the areas of the pulley and bearings that are subject to load and wear due to friction.

Casing centralizers and contact rings for downhole tools may be coated to reduce the friction resistance of placing such devices in a wellbore.

B. Coated Cylindrical Bodies that are Primarily Stationary:

There are diverse applications for coating portions of the exterior, interior, or both of cylindrical bodies (e.g., pipe or modified pipe), primarily for erosion, corrosion, and wear resistance, but also for friction reduction of fluid flow. The cylindrical bodies may be coaxial, contiguous, non-coaxial, non-contiguous or any combination thereof. In these applications, the coated cylindrical device may be essentially stationary for long periods of time, although perhaps a secondary benefit or application of the coatings is to reduce friction loads when the production device is installed.

An exemplary list of such applications is as follows:

Perforated basepipe, slotted basepipe, or screen basepipe for sand control are often subject to erosion and corrosion damage during the completion and stimulation treatment (e.g., gravel pack or frac pack treatment) and during the well productive life. For example, a coating obtained with the inventive method will provide greater inner diameter for the flow and reduce the flowing pressure drop relative to thicker plastic coatings. In another example, corrosive produced fluids may attack materials and cause material loss over time. Furthermore, highly productive formation intervals may provide fluid velocities that are sufficiently high to cause, erosion. These fluids may also carry solid particles, such as fines or formation sand with a tendency to fail the completion device. It is further possible for deposits of asphaltenes, paraffins, scale, and hydrates to form on the completion equipment such as basepipes. Coatings can provide benefits in these situations by reducing the effects of friction, wear, corrosion, erosion, and deposits. (See FIG. 8.) Certain coatings for screen applications have been disclosed in U.S. Pat. No. 6,742,586 B2.

Wash pipes, shunt tubes, and service tools used in the gravel pack operations may be coated internally, externally, or both to reduce erosion and flow resistance. Fluids with entrained solids for the gravel pack are pumped at high rates through these devices.

Blast joints may be advantageously coated for greater resistance to erosion resulting from impingement of fluids and solids at high velocity.

Figure 8:
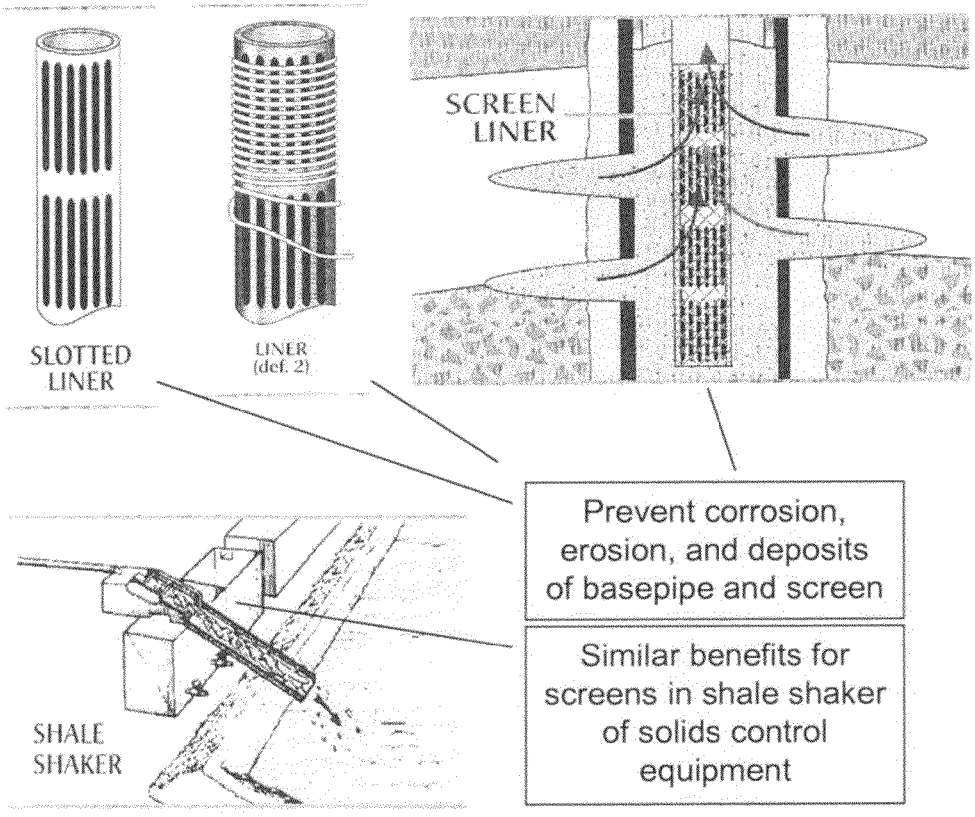
FIG. 8 depicts exemplary application of a coating applied to a basepipe and screen assembly used in gravel pack sand control operations and screens used in solids control equipment.

Thin metal meshes may be coated for friction reduction and resistance to corrosion and erosion. The coating process may be applied to individual cylindrical strands prior to weaving or to the collective mesh after the weave has been performed, or both, or in combination. A screen may be considered to be comprised of many cylinders. Wire strands may be drawn through a coating device to enable coating application of the entire surface area of the wire. The coating applications include but are not limited to: sand screens disposed within completion intervals, Mazeflo™ completion screens, sintered screens, wirewrap screens, shaker screens for solids control, and other screens used as oil and gas well production devices. The coating can be applied to at least a portion of filtering media, screen basepipe, or both. (See FIG. 8.) FIG. 8 depicts exemplary application of the coatings disclosed herein on screens and basepipe. In particular, the coatings disclosed herein may be applied to the slotted liner of screens 110 as well as basepipe 112 as shown in FIGS. 8A and 8B to prevent corrosion, erosion and deposits thereon. The coatings disclosed herein may also be applied to screens in the shale shaker 114 of solids control equipment as shown in FIG. 8C.

Coating may reduce material hardness requirements and mitigate the effects of corrosion and erosion for certain devices and components, enabling lower cost materials to be used as substitute for stellite, tungsten carbide, MP35N, high alloy materials, and other costly materials selected for this purpose.

C. Plates, Disks, and Complex Geometries:

There are many coatings applications that may be considered for non-cylindrical devices such as plates and disks or for more complex geometries. The benefits of coatings may be derived from a reduction in sliding contact friction and wear resulting from relative motion with respect to other devices, or perhaps a reduction in corrosion, erosion, and deposits from the interaction with fluid streams, or in many cases by a combination of both. These applications may benefit from the use of coatings as described below.

Figure 9:
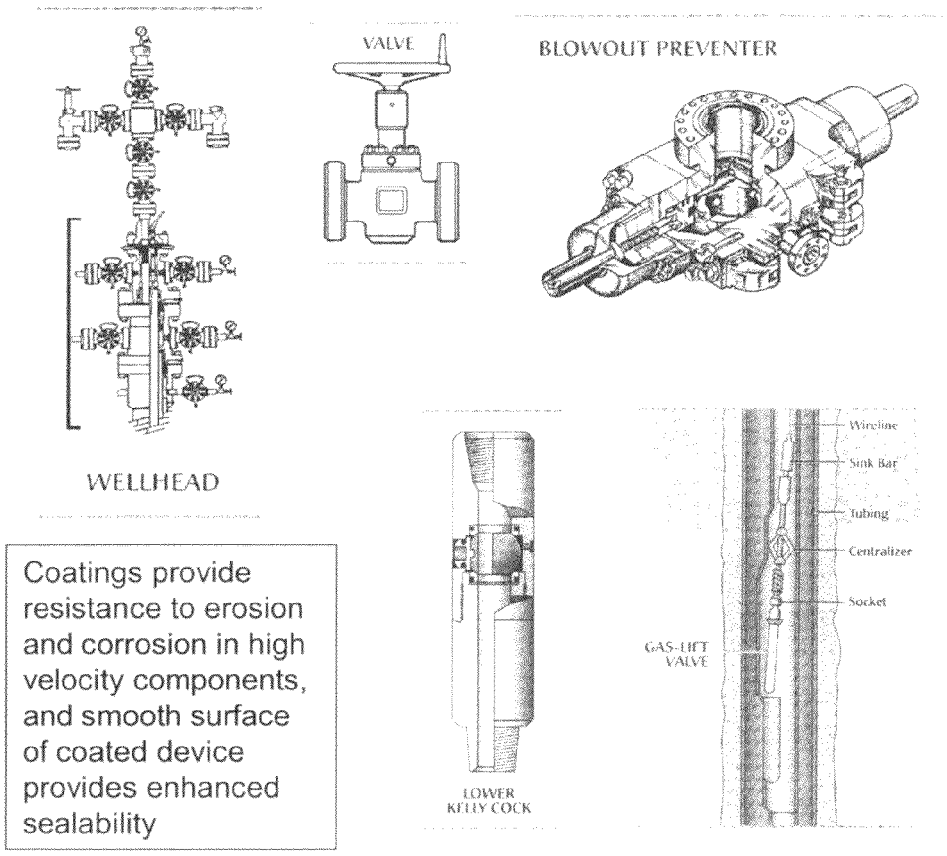
FIG. 9 depicts exemplary application of a coating applied to wellhead and valve assemblies.
Figure 10:
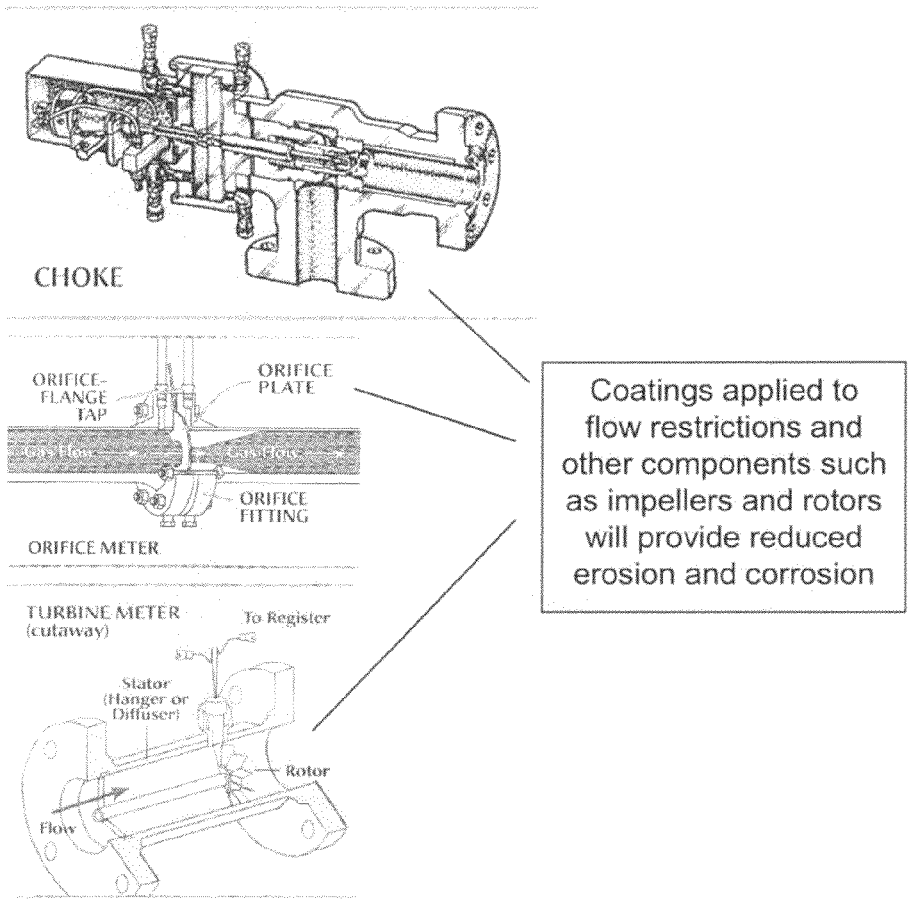
FIG. 10 depicts exemplary application of coatings applied to an orifice meter, a choke, and a turbine meter.

An exemplary list of such applications is as follows:

Chokes, valves, valve seats, seals, ball valves, inflow control devices, smart well valves, and annular isolation valves may be beneficially coated to reduce erosion, corrosion, and damage due to deposits. Many of these devices are used in wellhead equipment (see FIGS. 9 and 10). In particular, referring to FIGS. 9A, 9B, 9C, 9D and 9E, valves 110, blowout preventers 112, wellheads 114, lower Kelly cocks 116, and gas lift valves 118 may be coated with the coatings disclosed herein to provide resistance to erosion and corrosion in high velocity components, and the smooth surfaces of these coated devices provides enhanced sealability. In addition, referring to FIGS. 10A, 10B and 10C, chokes 120, orifice meters 122, and turbine meters 124 may have flow restrictions and other components (i.e. impellers and rotors) coated with the coatings disclosed herein to provide further resistance to erosion and corrosion. Other surface areas of the same production devices may benefit from reduced friction and wear obtained by using the same or different coating on a different portion of the production device.

Seats, nipples, valves, sidepockets, mandrels, packer slips, packer latches, etc. may be beneficially coated with low-friction coatings.

Subsurface safety valves are used to control flow in the event of possible loss of containment at the surface. These valves are routinely used in offshore wells to increase operational integrity and are often required by regulation. Improvements in the reliability and effectiveness of subsurface safety valves provide substantial benefits to operational integrity and may avoid a costly workover operation in the event that a valve fails a test. Enhanced sealability, resistance to corrosion, erosion, and deposits, and reduced friction and wear in moving valve devices may be highly beneficial for these reasons.

Gas lift and chemical injection valves are commonly used in tubing strings to enable injection of fluids, and coating portions of these devices will improve their performance. Gas lift is used to reduce the hydrostatic head and increase flow from a well, and chemicals are injected, for example, to inhibit formation of hydrates or scale in the well that would impede flow.

Elbows, tees, and couplings may be internally coated for fluid flow friction reduction and the prevention of buildup of scale and deposits.

The ball bearings, sleeve bearings, or journal bearings of rotating equipment may be coated to provide low friction and wear resistance, and to enable longer life of the bearing devices.

Bearings of roller cone bits may be beneficially coated with low-friction coatings.

Wear bushings may be beneficially coated with low-friction coatings.

Coating of dynamic metal-to-metal seals may be used to enhance or replace elastomers in reciprocating and/or rotating seal assemblies.

Moyno™ and progressive cavity pumps comprise a vaned rotor turning within a fixed stator. Coating one part or the other, or both, may enable improved operation and increase the pump efficiency and durability.

Impellers and stators in rotating pump equipment may be coated for erosion and wear resistance, and for durability where fine solids may be present in the flowstream. Such applications include submersible pumps.

Coating portions of a centrifuge used in solids control equipment at the surface may enhance the effectiveness of these devices by preventing plugging of the centrifuge discharge.

Springs in tools that are coated may have reduced contact friction and long service life reliability. Examples include safety valves, gas lift valves, shock subs, and jars.

Logging tool devices may be coated to improve operations involving deployment of arms, coring tubes, fluid sampling flasks, and other devices into the wellbore. Devices that are extended from and then retracted back into the tool may be less susceptible to jamming due to friction and solid deposits if coatings are applied.

Figure 11:
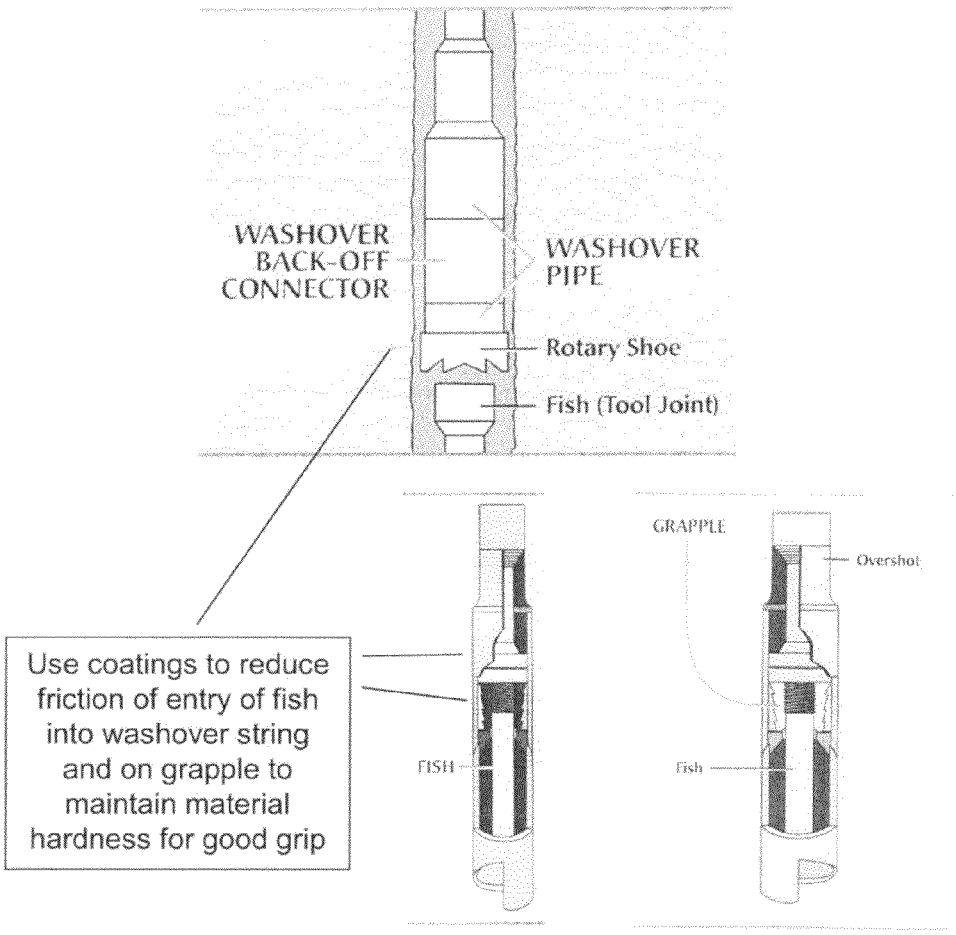
FIG. 11 depicts exemplary application of a coating applied to the grapple and overshot of a washover fishing tool.

Fishing equipment, including but not limited to, washover pipe, grapple, and overshot, may be beneficially coated to facilitate latching onto and removing a disconnected piece of equipment, or "fish," from the wellbore. Low friction entry into the washover pipe may be facilitated with coatings, and a hard coating on the grapple may improve the bite of the tool. (See FIG. 11.) In particular, referring to FIG. 11A, the coatings disclosed herein may be applied to washover pipe 130, washover pipe connectors 132, rotary shoes 134, and fishing devices to reduce friction of entry of fish 136 into the washover string. In addition, referring to FIG. 11B, the coatings disclosed herein may be applied to grapple 138 to maintain material hardness for good grip.

Sand probes and wellstream gauges to monitor pressure, temperature, flow rates, fluid concentrations, density, and other physical or chemical properties may be beneficially coated to extend life and resist damage due to wear, erosion, corrosion, and deposition of scale, asphaltenes, paraffin, and hydrates. An exemplary figure showing the absence of scale deposits and the presence of scale deposits in tubular goods 140 may be found in FIGS. 12A and 12B, respectively. In particular, FIG. 12A depicts tubulars 140 with full inner diameters because of no scale, asphaltene, paraffin, or hydrate deposits due to the use of the coatings disclosed herein on the inside and/or outside surfaces of the tubulars 140. In contrast, FIG. 12B depicts tubulars 140 with restricted flow capacity due to the build-up of scale and other deposits 142 on the inside and/or outside surfaces of the tubulars 140 because the low surface energy coatings dislosed herein were not utilized. The build-up of scale and other deposits 142 in tubulars 140 prevents wellbore access with logging tools.

D. Threaded Connections:

High strength pipe materials and special alloys in oilfield applications may be susceptible to galling, and threaded connections may be beneficially coated so as to reduce friction and increase surface hardness during connection makeup and to enable reuse of pipe and connections without redressing the threads. Seal performance may be improved by enabling higher contact stresses without risk of galling.

Pin and/or box threads of casing, tubing, drill pipe, drill collars, work strings, surface flowlines, stimulation treatment lines, threads used to connect downhole tools, marine risers, and other threaded connections involved in production operations may be beneficially coated with the low-friction coatings disclosed herein. Threads may be coated separately or in combination with current technology for improved connection makeup and galling resistance, including shot-peening and cold-rolling, and possibly but less likely, chemical treatments of the threads. (See FIG. 13.) Referring to FIG. 13A, the pin 150 and/or box 152 may be coated with the coatings disclosed herein. Referring to FIG. 13B, the threads 154 and/or shoulder 156 may be coated with the coatings disclosed herein. In FIG. 13C, the threaded connections (not shown) of threaded tubulars 158 may be coated with the coatings disclosed herein. In FIG. 13D, galling 159 of the threads 154 may be prevented by use of the coatings disclosed herein.

Detailed Applications and Benefits of Disclosed Coatings:

A detailed examination of one important aspect of production operations, the drilling process, can help to identify several challenges and opportunities for the beneficial use of coatings in the well production process.

Deep wells for the exploration and production of oil and gas are drilled with a rotary drilling system which creates a borehole by means of a rock cutting tool, a drill bit. The torque driving the bit is often generated at the surface by a motor with mechanical transmission box. Via the transmission, the motor drives the rotary table or top drive unit. The medium to transport the energy from the surface to the drill bit is a drill string, mainly consisting of drill pipes. The lowest part of the drill string is the bottom hole assembly (abbreviated herein as BHA) consisting of drill collars, stabilizers and others including measurement devices, under-reamers, motors, and other devices known to those skilled in the art. The combination of the drill string and the bottom hole assembly is referred to herein as a drill stem assembly. Alternatively, coiled tubing may replace the drill string, and the combination of coiled tubing and the bottom hole assembly is also referred to herein as a drill stem assembly. The bottom hole assembly is connected to the drill bit at the drilling end.

For the case of a drill stem assembly including a drill string, periodically during drilling operations, new sections of drill pipe are added to the drill stem, and the upper sections of the borehole are normally cased to stabilize the wells, and drilling is resumed. Thus, the drill stem assembly (drill string/BHA) undergoes various types of friction and wear caused by interaction between the drill string/BHA/bit and the casing ("cased hole" part of the borehole) or the rock cuttings and mud in the annulus or drill string/BHA/bit with open borehole ("open hole" part of the borehole).

The trend in drilling is deeper and harder formations where the low rate of penetration (abbreviated herein as ROP) leads to high drilling costs. In other areas such as deep shale drilling, bottom hole balling may occur wherein shale cuttings stick to the bit cutting face by differential mud pressure across the cuttings-mud and cuttings-bit face, reducing drilling efficiencies and ROP significantly. Sticking of cuttings to the BHA devices such as stabilizers can also lead to drilling inefficiencies.

Figure 14:
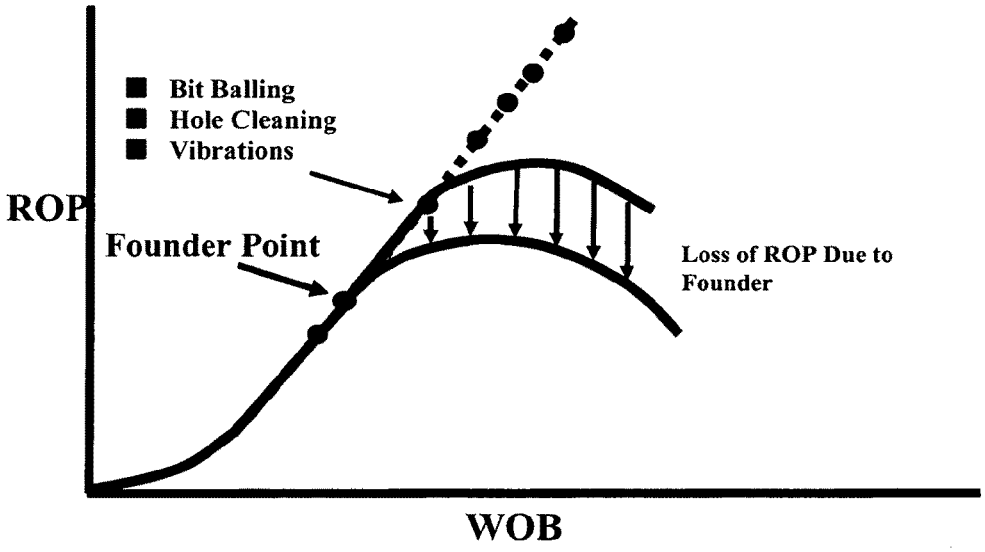
FIGURE 14 (Prior Art)
FIG. 14 depicts, schematically, the rate of penetration (ROP) versus weight on bit (WOB) during subterraneous rotary drilling.

Drill stem assembly friction and wear are important causes for premature failure of drill string or coiled tubing and the associated drilling inefficiencies. Stabilizer wear can affect the borehole quality in addition to leading to vibrational inefficiencies. These inefficiencies can manifest themselves as ROP limiters or "founder points" in the sense that the ROP does not increase linearly with weight on bit (abbreviated herein as WOB) and revolutions per minute (abbreviated herein as RPM) of the bit as predicted from bit mechanics. This limitation is depicted schematically in FIG. 14.

It has been recognized in the drilling industry that drill stem vibrations and bit balling are two of the most challenging rate of penetration limiters. The coatings disclosed herein when applied to the drill stem assembly help to mitigate these ROP limitations.

The deep drilling environment, especially in hard rock formations, induces severe vibrations in the drill stem assembly, which can cause reduced drill bit rate of penetration and premature failure of the equipment downhole. The two main vibration excitation sources are interactions between drill bit and rock formation, and between the drill stem assembly and wellbore or casing. As a consequence, the drill stem assembly vibrates axially, torsionally, laterally or usually with a combination of these three basic modes, that is, coupled vibrations. Therefore, this leads to a complex problem. A particularly challenging form of drill stem assembly vibration is stick-slip vibration mode, which is a manifestation of torsional instability. The static contact friction of various drill stem assembly devices with the casing/borehole, and also the dynamic response of this contact friction as a function of rotary speed may be important for the onset of stick-slip vibrations. For example, it is suggested that the bit induced stick-slip torsional instability may be triggered by velocity weakening of contact friction at the bit-borehole surfaces wherein the dynamic contact friction is lower than static friction.

With today's advanced technology, multiple lateral wellbores may be drilled from the same starter wellbore. This may mean drilling over far longer depths and the use of directional drilling technology, e.g., through the use of rotary steerable systems (abbreviated herein as RSS). Although this gives major cost and logistical advantages, it also greatly increases wear on the drill string and casing. In some cases of directional or extended reach drilling, the degree of vertical deflection, inclination (angle from the vertical), can be as great as 90°, which are commonly referred to as horizontal wells. In drilling operations, the drill string assembly has a tendency to rest against the side wall of the borehole or the well casing. This tendency is much greater in directional wells due to the effect of gravity. As the drill string increases in length and/or degree of deflection, the overall frictional drag created by rotating the drill string also increases. To overcome this increase in frictional drag, additional power is required to rotate the drill string. The resultant wear and the string/casing friction are critical to the drilling efficiency operation. The measured depth that can be achieved in these situations may be limited by the available torque capacity of the drilling rig. There is a need to find more efficient solutions to extend equipment lifetime and drilling capabilities with existing rigs and drive mechanisms to extend the lateral reach of these operations. It has been discovered that coating portions or all of the drill stem assembly with coatings may resolve these issues. FIGS. 2 and 3 depict areas of the drill stem assembly where the coatings disclosed herein may be applied to reduce friction and wear during drilling.

Another aspect of the instant invention relates to the use of coatings to improve the performance of drilling tools, particularly a bottomhole assembly for drilling in formations containing clay and similar substances. The present invention utilizes the low surface energy novel materials or coating systems to provide thermodynamically low energy surfaces, e.g., non-water wetting surface for bottom hole devices. The coatings disclosed herein are suitable for oil and gas drilling in gumbo-prone areas, such as in deep shale drilling with high clay contents using water-based muds (abbreviated herein as WBM) to prevent bottom hole assembly balling.

Furthermore, the coatings disclosed herein when applied to the drill string assembly can simultaneously reduce contact friction, balling and reduce wear while not compromising the durability and mechanical integrity of casing. Thus, the coatings disclosed herein are "casing friendly" in that they do not degrade the life or functionality of the casing. The coatings disclosed herein are also characterized by low or no sensitivity to velocity weakening friction behavior. Thus, the drill stem assemblies provided with the coatings disclosed herein provide low friction surfaces with advantages in both mitigating stick-slip vibrations and reducing parasitic torque to further enable ultra-extended reach drilling.

The coatings disclosed herein for drill stem assemblies provide for the following exemplary non-limiting advantages: i) mitigating stick-slip vibrations, ii) reducing torque and drag for extending the reach of extended reach wells and iii) mitigating drill bit and other bottom hole assembly balling. These three advantages together with minimizing the parasitic torque may lead to significant improvements in drilling rate of penetration as well as durability of downhole drilling equipment, thereby also contributing to reduced non-productive time (abbreviated herein as NPT). The coatings disclosed herein not only reduce friction, but also withstand the aggressive downhole drilling environments requiring chemical stability, corrosion resistance, impact resistance, durability against wear, erosion and mechanical integrity (coating-substrate interface strength). The coatings disclosed herein are also amenable for application to complex geometries without damaging the substrate properties. Moreover, the coatings disclosed herein also provide low energy surfaces necessary to provide resistance to balling of bottom hole devices.

This discussion of the drilling process has focused on the friction and wear benefits of the coatings, with primary application to cylinders in sliding contact, and has also identified the benefits of low energy surfaces for reduced sticking of formation cuttings to bottom hole devices. These same technical discussions pertain to other instances of cylinders in sliding contact due to relative motion, with modified circumstances accordingly.

In a similar fashion, other common geometric parameters have been identified as described above: plates, disks, and complex geometries in relative motion; stationary cylindrical bodies; stationary devices in production equipment with complex geometry; and threaded connections.

Friction and wear reduction are primary motivations for the application of coatings to bodies in sliding contact due to relative motion, whether the geometry comprises cylinders, plates and disks, or more complex geometries. For stationary devices, the incentives and benefits of coatings are slightly different. Although friction and wear may be important secondary factors (for instance in the initial installation of the device), the primary benefits of coatings may be their resistance to erosion, corrosion, and deposits, and these factors then become major dimensions in their selection and use.

Exemplary Embodiments of the Current Invention

In one exemplary embodiment of the current invention, a coated oil and gas well production device comprises an oil and gas well production device including one or more cylindrical bodies, and a coating on at least a portion of the one or more cylindrical bodies, wherein the coating is chosen from an amorphous alloy, a heat-treated electroless or electro plated nickel-phosphorous based composite with a phosphorous content greater than 12 wt %, graphite, $MoS_2$, $WS_2$, a fullerene based composite, a boride based cermet, a quasicrystalline material, a diamond based material, diamond-like-carbon (DLC), boron nitride, and combinations thereof.

In another exemplary embodiment of the current invention, the coated oil and gas well production device comprises an oil and gas well production device including one or more bodies with the proviso that the one or more bodies does not include a drill bit, and a coating on at least a portion of the one or more bodies, wherein the coating is chosen from an amorphous alloy, a heat-treated electroless or electro plated nickel-phosphorous composite with a phosphorous content greater than 12 wt %, graphite, $MoS_2$, $WS_2$, a fullerene based composite, a boride based cermet, a quasicrystalline material, a diamond based material, diamond-like-carbon (DLC), boron nitride, and combinations thereof.

The coefficient of friction of the coating may be less than or equal to 0.15, or 0.13, or 0.11, or 0.09 or 0.07 or 0.05. The friction force may be calculated as follows: Friction Force=Normal Force×Coefficient of Friction. In another form, the coated oil and gas well production device may have a dynamic friction coefficient of the coating that is not lower than 50%, or 60%, or 70%, or 80% or 90% of the static friction coefficient of the coating. In yet another form, the coated oil and gas well production device may have a dynamic friction coefficient of the coating that is greater than or equal to the static friction coefficient of the coating.

The coated oil and gas well production device may be fabricated from iron based steels, Al-base alloys, Ni-base alloys and Ti-base alloys. 4142 type steel is one non-limiting exemplary iron based steel used for oil and gas well production devices. The surface of the iron based steel substrate may be optionally subjected to an advanced surface treatment prior to coating application. The advanced surface treatment may provide one or more of the following benefits: extended durability, enhanced wear, reduced friction coefficient, enhanced fatigue and extended corrosion performance of the coating layer(s). Non-limited exemplary advanced surface treatments include ion implantation, nitriding, carburizing, shot peening, laser and electron beam glazing, laser shock peening, and combinations thereof. Such surface treatments may harden the substrate surface by introducing additional species and/or introduce deep compressive residual stress resulting in inhibition of the crack growth induced by fatigue, impact and wear damage.

The coating disclosed herein may be chosen from an amorphous alloy, electroless and/or electro plating nickel-phosphorous based composite, graphite, $MoS_2$, $WS_2$, a fullerene based composite, a boride based cermet, a quasicrystalline material, a diamond based material, diamond-like-carbon (DLC), boron nitride, and combinations thereof. The diamond based material may be chemical vapor deposited (CVD) diamond or polycrystalline diamond compact (PDC). In one advantageous embodiment, the coated oil and gas well production device is coated with a diamond-like-carbon (DLC) coating, and more particularly the DLC coating may be chosen from tetrahedral amorphous carbon (ta-C), tetrahedral amorphous hydrogenated carbon (ta-C:H), diamond-like hydrogenated carbon (DLCH), polymer-like hydrogenated carbon (PLCH), graphite-like hydrogenated carbon (GLCH), silicon containing diamond-like-carbon (Si-DLC), metal containing diamond-like-carbon (Me-DLC), oxygen containing diamond-like-carbon (O-DLC), nitrogen containing diamond-like-carbon (N-DLC), boron containing diamond-like-carbon (B-DLC), fluorinated diamond-like-carbon (F-DLC) and combinations thereof.

Significantly decreasing the coefficient of friction (COF) of the oil and gas well production device will result in a significant decrease in the friction force. This translates to a smaller force required to slide the cuttings along the surface when the device is a coated drill stem assembly. If the friction force is low enough, it may be possible to increase the mobility of cuttings along the surface until they can be lifted off the surface of the drill stem assembly or transported to the annulus. It is also possible that the increased mobility of the cuttings along the surface may inhibit the formation of differentially stuck cuttings due to the differential pressure between mud and mud-squeezed cuttings-cutter interface region holding the cutting onto the cutter face. Lowering the COF on oil and gas well production device surfaces is accomplished by coating these surfaces with coatings disclosed herein. These coatings applied to the oil and gas well production device are able to withstand the aggressive environments of drilling including resistance to corrosion, impact loading and exposure to high temperatures.

Figure 15:
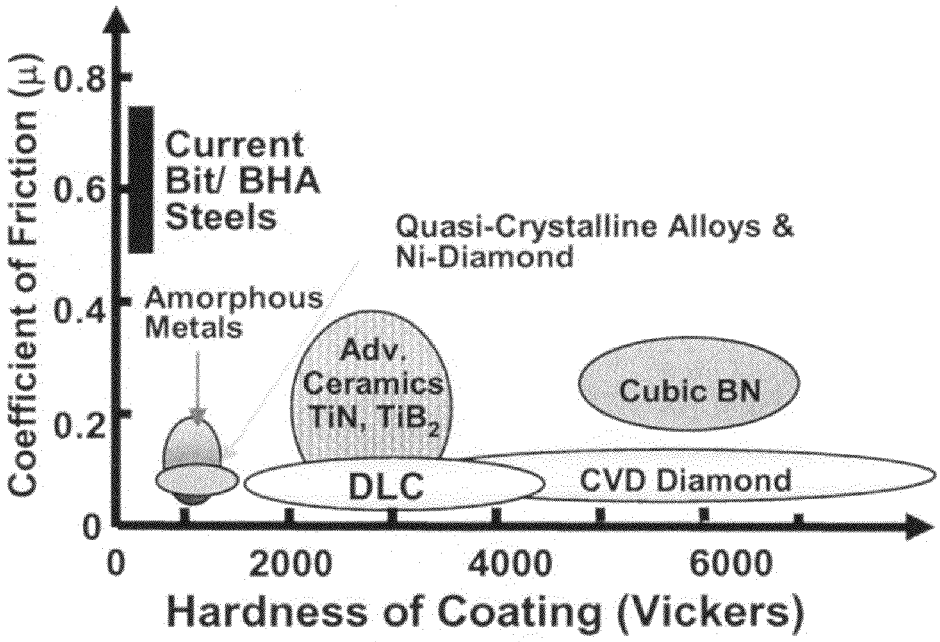
FIG. 15 depicts the relationship between coating COF and coating hardness for some of the coatings disclosed herein versus steel base case.

In addition to low COF, the coatings of the present invention are also of sufficiently high hardness to provide durability against wear during oil and gas well production operations. More particularly, the Vickers hardness or the equivalent Vickers hardness of the coatings on the oil and gas well production device disclosed herein may be greater than or equal to 400, 500, 600, 700, 800, 900, 1000, 1500, 2000, 2500, 3000, 3500, 4000, 4500, 5000, 5500, or 6000. A Vickers hardness of greater than 400 allows for the coated oil and gas well production device when used as a drill stem assembly to be used for drilling in shales with water based muds and the use of spiral stabilizers. Spiral stabilizers have less tendency to cause BHA vibrations than straight-bladed stabilizers. FIG. 15 depicts the relationship between coating COF and coating hardness for some of the coatings disclosed herein relative to the prior art drill string and BHA steels. The combination of low COF and high hardness for the coatings disclosed herein when used as a surface coating on the drill stem assemblies provides for hard, low COF durable materials for downhole drilling applications.

The coated oil and gas well production devices with the coatings disclosed herein also provide a surface energy less than 1, 0.9, 0.8, 0.7, 0.6, 0.5, 0.4, 0.3, 0.2, or 0.1 $J/m^2$. In subterraneous rotary drilling operations, this helps to mitigate sticking or balling by rock cuttings. Contact angle may also be used to quantify the surface energy of the coatings on the coated oil and gas well production devices disclosed herein. The water contact angle of the coatings disclosed herein is greater than 50, 60, 70, 80, or 90 degrees.

Figure 16:
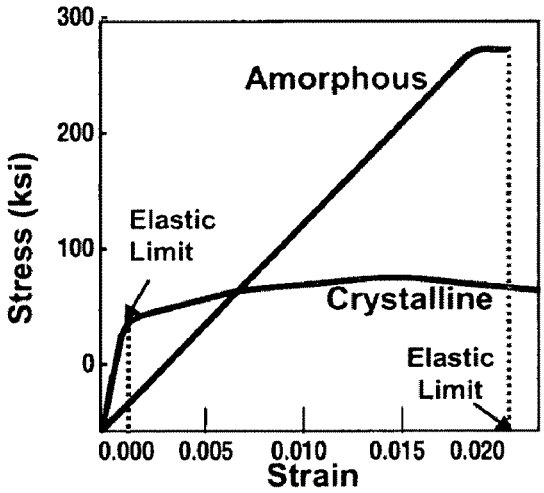
FIG. 16 depicts a representative stress-strain curve showing the high elastic limit of amorphous alloys compared to that of crystalline metals/alloys.

Further details regarding the coatings disclosed herein for use in coated oil and gas well production devices are as follows:

Amorphous Alloys:

Amorphous alloys as coatings for coated oil and gas well production devices disclosed herein provide high elastic limit/flow strength with relatively high hardness. These attributes allow these materials, when subjected to stress or strain, to stay elastic for higher strains/stresses as compared to the crystalline materials such as the steels used in drill stem assemblies. The stress-strain relationship between the amorphous alloys as coatings for drill stem assemblies and conventional crystalline alloys/steels is depicted in FIG. 16, and shows that conventional crystalline alloys/steels can easily transition into plastic deformation at relatively low strains/stresses in comparison to amorphous alloys. Premature plastic deformation at the contacting surfaces leads to surface asperity generation and the consequent high asperity contact forces and COF in crystalline metals. The high elastic limit of amorphous metallic alloys or amorphous materials in general can reduce the formation of asperities resulting also in significant enhancement of wear resistance. Amorphous alloys as coatings for oil and gas well production devices would result in reduced asperity formation during production operations and thereby reduced COF of the device.

Amorphous alloys as coatings for oil and gas well production devices may be deposited using a number of coating techniques including, but not limited to, thermal spraying, cold spraying, weld overlay, laser beam surface glazing, ion implantation and vapor deposition. Using a scanned laser or electron beam, a surface can be glazed and cooled rapidly to form an amorphous surface layer. In glazing, it may be advantageous to modify the surface composition to ensure good glass forming ability and to increase hardness and wear resistance. This may be done by alloying into the molten pool on the surface as the heat source is scanned. Hardfacing coatings may be applied also by thermal spraying including plasma spraying in air or in vacuum. Thinner, fully amorphous coatings as coatings for oil and gas well production devices may be obtained by thin film deposition techniques including, but not limited to, sputtering, chemical vapor deposition (CVD) and electrodeposition. Some amorphous alloy compositions disclosed herein, such as near equiatomic stoichiometry (e.g., Ni—Ti), may be amorphized by heavy plastic deformation such as shot peening or shock loading. The amorphous alloys as coatings for oil and gas well production devices disclosed herein yield an outstanding balance of wear and friction performance and require adequate glass forming ability for the production methodology to be utilized.

Ni—P Based Composite Coatings:

Electroless and electro plating of nickel-phosphorous (Ni—P) based composites as coatings for oil and gas well production devices disclosed herein may be formed by codeposition of inert particles onto a metal matrix from an electrolytic or electroless bath. The Ni—P composite coating provides excellent adhesion to most metal and alloy substrates. The final properties of these coatings depend on the phosphorous content of the Ni—P matrix, which determines the structure of the coatings, and on the characteristics of the embedded particles such as type, shape and size. Ni—P coatings with low phosphorus content are crystalline Ni with supersaturated P. With increasing P content, the crystalline lattice of nickel becomes more and more strained and the crystallite size decreases. At a phosphorous content greater than 12 wt %, or 13 wt %, or 14 wt % or 15 wt %, the coatings exhibit a predominately amorphous structure. Annealing of amorphous Ni—P coatings may result in the transformation of amorphous structure into an advantageous crystalline state. This crystallization may increase hardness, but deteriorate corrosion resistance. The richer the alloy in phosphorus, the slower the process of crystallization. This expands the amorphous range of the coating. The Ni—P composite coatings can incorporate other metallic elements including, but not limited to, tungsten (W) and molybdenum (Mo) to further enhance the properties of the coatings. The nickel-phosphorous (Ni—P) based composite coating disclosed herein may include micron-sized and sub-micron sized particles. Non-limiting exemplary particles include: diamonds, nanotubes, carbides, nitrides, borides, oxides and combinations thereof. Other non-limiting exemplary particles include plastics (e.g., fluoro-polymers) and hard metals.

Layered Materials and Novel Fullerene Based Composite Coating Layers:

Layered materials such as graphite, $MoS_2$ and $WS_2$ (platelets of the 2H polytype) may be used as coatings for oil and gas well production devices. In addition, fullerene based composite coating layers which include fullerene-like nanoparticles may also be used as coatings for oil and gas well production devices. Fullerene-like nanoparticles have advantageous tribological properties in comparison to typical metals while alleviating the shortcomings of conventional layered materials (e.g., graphite, $MoS_2$). Nearly spherical fullerenes may also behave as nanoscale ball bearings. The main favorable benefit of the hollow fullerene-like nanoparticles may be attributed to the following three effects. (a) rolling friction, (b) the fullerene nanoparticles function as spacers, which eliminate metal to metal contact between the asperities of the two mating metal surfaces, and (c) three body material transfer. Sliding/rolling of the fullerene-like nanoparticles in the interface between rubbing surfaces may be the main friction mechanism at low loads, when the shape of nanoparticle is preserved. The beneficial effect of fullerene-like nanoparticles increases with the load. Exfoliation of external sheets of fullerene-like nanoparticles was found to occur at high contact loads (~1 GPa). The transfer of delaminated nanoparticles appears to be the dominant friction mechanism at severe contact conditions. The mechanical and tribological properties of fullerene-like nanoparticles can be exploited by the incorporation of these particles in binder phases of coating layers. In addition, composite coatings incorporating fullerene-like nanoparticles in a metal binder phase (e.g., Ni—P electroless plating) can provide a film with self-lubricating and excellent anti-sticking characteristics suitable for coatings for oil and gas well production devices.

Advanced Boride Based Cermets and Metal Matrix Composites:

Advanced boride based cermets and metal matrix composites as coatings for oil and gas well production devices may be formed on bulk materials due to high temperature exposure either by heat treatment or incipient heating during wear service. For instance, boride based cermets (e.g., $TiB_2$-metal), the surface layer is typically enriched with boron oxide (e.g, $B_2O_3$) which enhances to lubrication performance leading to low friction coefficient.

Quasicrystalline Materials:

Quasicrystalline materials may be used as coatings for oil and gas well production devices. Quasicrystalline materials have periodic atomic structure, but do not conform to the 3-D symmetry typical of ordinary crystalline materials. Due to their crystallographic structure, most commonly icosahedral or decagonal, quasicrystalline materials with tailored chemistry exhibit unique combination of properties including low energy surfaces, attractive as a coating material for oil and gas well production devices. Quasicrystalline materials provide non-stick surface properties due to their low surface energy (~30 $mJ/m^2$) on stainless steel substrate in icosahedral Al—Cu—Fe chemistries. Quasicrystalline materials as coating layers for oil and gas well production devices may provide a combination of low friction coefficient (~0.05 in scratch test with diamond indentor in dry air) with relatively high microhardness (400~600 HV) for wear resistance. Quasicrystalline materials as coating layers for oil and gas well production devices may also provide a low corrosion surface and the coated layer has smooth and flat surface with low surface energy for improved performance. Quasicrystalline materials may be deposited on a metal substrate by a wide range of coating technologies, including, but not limited to, thermal spraying, vapor deposition, laser cladding, weld overlaying, and electrodeposition.

Super-Hard Materials (Diamond, Diamond Like Carbon, Cubic Boron Nitride):

Super-hard materials such as diamond, diamond-like-carbon (DLC) and cubic boron nitride (CBN) may be used as coatings for oil and gas well production devices. Diamond is the hardest material known to man and under certain conditions may yield ultra-low coefficient of friction when deposited by chemical vapor deposition (abbreviated herein as CVD) on oil and gas well production devices. In one form, the CVD deposited carbon may be deposited directly on the surface of the oil and gas well production device. In another form, an undercoating of a compatibilizer material (also referred to herein as a buffer layer) may be applied to the oil and gas well production device prior to diamond deposition. For example, when used on drill stem assemblies, a surface coating of CVD diamond may provide not only reduced tendency for sticking of cuttings at the surface, but also function as an enabler for using spiral stabilizers in operations with gumbo prone drilling (such as for example in the Gulf of Mexico). Coating the flow surface of the spiral stabilizers with CVD diamond may enable the cuttings to flow past the stabilizer up hole into the drill string annulus without sticking to the stabilizer.

In one advantageous embodiment, diamond-like-carbon (DLC) may be used as coatings for oil and gas well production devices. DLC refers to amorphous carbon material that display some of the unique properties similar to that of natural diamond. The diamond-like-carbon (DLC) suitable for oil and gas well production devices may be chosen from ta-C, ta-C:H, DLCH, PLCH, GLCH, Si-DLC, Me-DLC, F-DLC and combinations thereof. DLC coatings include significant amounts of $sp^3$ hybridized carbon atoms. These $sp^3$ bonds may occur not only with crystals—in other words, in solids with long-range order—but also in amorphous solids where the atoms are in a random arrangement. In this case there will be bonding only between a few individual atoms, that is short-range order, and not in a long-range order extending over a large number of atoms. The bond types have a considerable influence on the material properties of amorphous carbon films. If the $sp^2$ type is predominant the DLC film may be softer, whereas if the $sp^3$ type is predominant, the DLC film may be harder.

Figure 17:
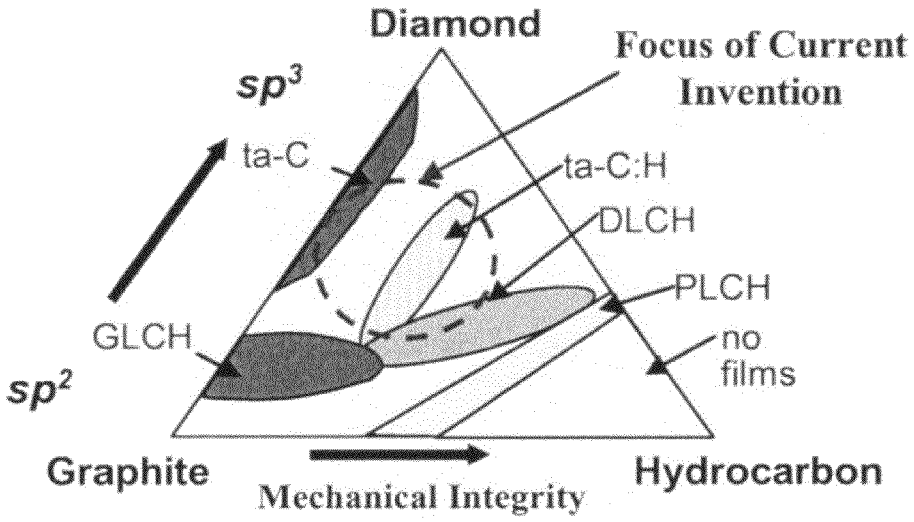
FIG. 17 depicts a ternary phase diagram of amorphous carbons.

DLC coatings may be fabricated as amorphous, flexible, and yet purely $sp^3$ bonded "diamond". The hardest is such a mixture, known as tetrahedral amorphous carbon, or ta-C (see FIG. 17). Such ta-C includes a high volume fraction (~80%) of $sp^3$ bonded carbon atoms. Optional fillers for the DLC coatings, include, but are not limited to, hydrogen, graphitic $sp^2$ carbon, and metals, and may be used in other forms to achieve a desired combination of properties depending on the particular application. The various forms of DLC coatings may be applied to a variety of substrates that are compatible with a vacuum environment and that are also electrically conductive. DLC coating quality is also dependent on the fractional content of alloying elements such as hydrogen. Some DLC coating methods require hydrogen or methane as a precursor gas, and hence a considerable percentage of hydrogen may remain in the finished DLC material. In order to further improve their tribological and mechanical properties, DLC films are often modified by incorporating other alloying elements. For instance, the addition of fluorine (F), and silicon (Si) to the DLC films lowers the surface energy and wettability. The reduction of surface energy in fluorinated DLC (F-DLC) is attributed to the presence of –CF2 and –CF3 groups in the film. However, higher F contents may lead to a lower hardness. The addition of Si may reduce surface energy by decreasing the dispersive component of surface energy. Si addition may also increase the hardness of the DLC films by promoting $sp^3$ hybridization in DLC films. Addition of metallic elements (e.g., W, Ta, Cr, Ti, Mo) to the film, as well as the use of such metallic interlayer can reduce the compressive residual stresses resulting in better mechanical integrity of the film upon compressive loading.

The diamond-like phase or $sp^3$ bonded carbon of DLC is a thermodynamically metastable phase while graphite with $sp^2$ bonding is a thermodynamically stable phase. Thus the formation of DLC coating films requires non-equilibrium processing to obtain metastable $sp^3$ bonded carbon. Equilibrium processing methods such as evaporation of graphitic carbon, where the average energy of the evaporated species is low (close to kT where k is Boltzmann's constant and T is temperature in absolute temperature scale), lead to the formation of 100% $sp^2$ bonded carbons. The methods disclosed herein for producing DLC coatings require that the carbon in the $sp^3$ bond length be significantly less than the length of the $sp^2$ bond. Hence, the application of pressure, impact, catalysis, or some combination of these at the atomic scale may force $sp^2$ bonded carbon atoms closer together into $sp^3$ bonding. This may be done vigorously enough such that the atoms cannot simply spring back apart into separations characteristic of $sp^2$ bonds. Typical techniques either combine such a compression with a push of the new cluster of $sp^3$ bonded carbon deeper into the coating so that there is no room for expansion back to separations needed for $sp^2$ bonding; or the new cluster is buried by the arrival of new carbon destined for the next cycle of impacts.

The DLC coatings disclosed herein may be deposited by physical vapor deposition, chemical vapor deposition, or plasma assisted chemical vapor deposition coating techniques. The physical vapor deposition coating methods include RF-DC plasma reactive magnetron sputtering, ion beam assisted deposition, cathodic arc deposition and pulsed laser deposition (PLD). The chemical vapor deposition coating methods include ion beam assisted CVD deposition, plasma enhanced deposition using a glow discharge from hydrocarbon gas, using a radio frequency (r.f.) glow discharge from a hydrocarbon gas, plasma immersed ion processing and microwave discharge. Plasma enhanced chemical vapor deposition (PECVD) is one advantageous method for depositing DLC coatings on large areas at high deposition rates. Plasma based CVD coating process is a non-line-of-sight technique, i.e. the plasma conformally covers the part to be coated and the entire exposed surface of the part is coated with uniform thickness. The surface finish of the part may be retained after the DLC coating application. One advantage of PECVD is that the temperature of the substrate part does not increase above about 150° C. during the coating operation. The fluorine-containing DLC (F-DLC) and silicon-containing DLC (Si-DLC) films can be synthesized using plasma deposition technique using a process gas of acetylene ($C_2H_2$) mixed with fluorine-containing and silicon-containing precursor gases respectively (e.g., tetra-fluoro-ethane and hexa-methyl-disiloxane).

Figure 18:
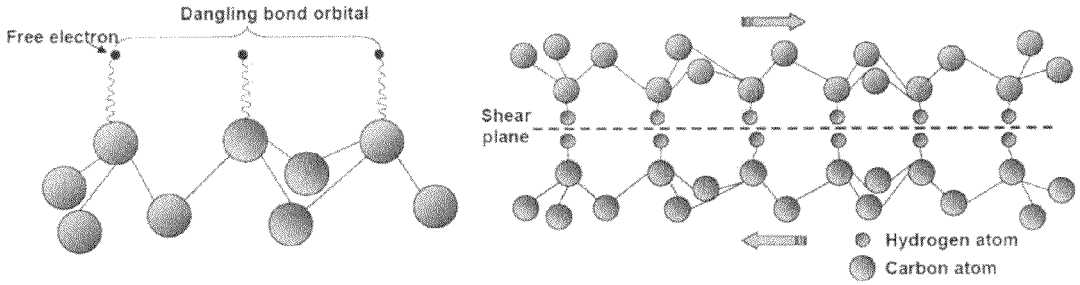
FIG. 18 depicts a schematic illustration of the hydrogen dangling bond theory.

The DLC coatings disclosed herein may exhibit coefficients of friction within the ranges earlier described. The ultra-low COF may be based on the formation of a thin graphite film in the actual contact areas. As $sp^3$ bonding is a thermodynamically unstable phase of carbon at elevated temperatures of 600 to 1500° C., depending on the environmental conditions, it may transform to graphite which may function as a solid lubricant. These high temperatures may occur as very short flash (referred to as the incipient temperature) temperatures in the asperity collisions or contacts. An alternative theory for the ultra-low COF of DLC coatings is the presence of hydrocarbon-based slippery film. The tetrahedral structure of a $sp^3$ bonded carbon may result in a situation at the surface where there may be one vacant electron coming out from the surface, that has no carbon atom to attach to (see FIG. 18), which is referred to as a "dangling bond" orbital. If one hydrogen atom with its own electron is put on such carbon atom, it may bond with the dangling bond orbital to form a two-electron covalent bond. When two such smooth surfaces with an outer layer of single hydrogen atoms slide over each other, shear will take place between the hydrogen atoms. There is no chemical bonding between the surfaces, only very weak van der Waals forces, and the surfaces exhibit the properties of a heavy hydrocarbon wax. As illustrated in FIG. 18, carbon atoms at the surface may make three strong bonds leaving one electron in the dangling bond orbital pointing out from the surface. Hydrogen atoms attach to such surface which becomes hydrophobic and exhibits low friction.

The DLC coatings for oil and gas well production devices disclosed herein also prevent wear due to their tribological properties. In particular, the DLC coatings disclosed herein are resistant to abrasive and adhesive wear making them suitable for use in applications that experience extreme contact pressure, both in rolling and sliding contact.

In addition to low friction and wear/abrasion resistance, the DLC coatings for oil and gas well production devices disclosed herein also exhibit durability and adhesive strength to the outer surface of the body assembly for deposition. DLC coating films may possess a high level of intrinsic residual stress (~1 GPa) which has an influence on their tribological performance and adhesion strength to the substrate (e.g., steel) for deposition. Typically DLC coatings deposited directly on steel surface suffer from poor adhesion strength. This lack of adhesion strength restricts the thickness and the incompatibility between DLC and steel interface, which may result in delamination at low loads. To overcome these problems, the DLC coatings for oil and gas well production devices disclosed herein may also include interlayers of various metallic (for example, but not limited to, Cr, W, Ti) and ceramic compounds (for example, but not limited to, CrN, SiC) between the outer surface of the oil and gas well production device and the DLC coating layer. These ceramic and metallic interlayers relax the compressive residual stress of the DLC coatings disclosed herein to increase the adhesion and load carrying capabilities. An alternative approach to improving the wear/friction and mechanical durability of the DLC coatings disclosed herein is to incorporate multilayers with intermediate buffering layers to relieve residual stress build-up and/or duplex hybrid coating treatments. In one form, the outer surface of the oil and gas well production device for treatment may be nitrided or carburized, a precursor treatment prior to DLC coating deposition, in order to harden and retard plastic deformation of the substrate layer which results in enhanced coating durability.

Multi-Layered Coatings and Hybrid Coatings:

Multi-layered coatings on oil and gas well production devices are disclosed herein and may be used in order to maximize the thickness of the coatings for enhancing their durability. The coated oil and gas well production devices disclosed herein may include not only a single layer, but also two or more coating layers. For example, two, three, four, five or more coating layers may be deposited on portions of the oil and gas well production device. Each coating to layer may range from 0.5 to 5000 microns in thickness with a lower limit of 0.5, 0.7, 1.0, 3.0, 5.0, 7.0, 10.0, 15.0, or 20.0 microns and an upper limit of 25, 50, 75, 100, 200, 500, 1000, 3000, or 5000 microns. The total thickness of the multi-layered coating may range from 0.5 to 30,000 microns. The lower limit of the total multi-layered coating thickness may be 0.5, 0.7, 1.0, 3.0, 5.0, 7.0, 10.0, 15.0, or 20.0 microns in thickness. The upper limit of the total multi-layered coating thickness may be 25, 50, 75, 100, 200, 500, 1000, 3000, 5000, 10000, 15000, 20000, or 30000 microns in thickness.

In another embodiment of the coated oil and gas well production devices disclosed herein, the body assembly of the oil and gas well production device may include hardbanding on at least a portion of the exposed outer surface to provide enhanced wear resistance and durability. Hence, the one or more coating layers are deposited on top of the hardbanding to form a hybrid type coating structure. The thickness of hardbanding layer may range from several times that of to equal to the thickness of the outer coating layer or layers. Non-limiting exemplary hardbanding materials include cermet based materials, metal matrix composites, nanocrystalline metallic alloys, amorphous alloys and hard metallic alloys. Other non-limiting exemplary types of hardbanding include carbides, nitrides, borides, and oxides of elemental tungsten, titanium, niobium, molybdenum, iron, chromium, and silicon dispersed within a metallic alloy matrix. Such hardbanding may be deposited by weld overlay, thermal spraying or laser/electron beam cladding.

The coatings for use in oil and gas well production devices disclosed herein may also include one or more buffer layers (also referred to herein as adhesive layers). The one or more buffer layers may be interposed between the outer surface of the body assembly and the single layer or the two or more layers in a multi-layer coating configuration. The one or more buffer layers may be chosen from the following elements or alloys of the following elements: silicon, titanium, chromium, tungsten, tantalum, niobium, vanadium, zirconium, and/or hafnium. The one or more buffer layers may also be chosen from carbides, nitrides, carbo-nitrides, oxides of the following elements: silicon, titanium, chromium, tungsten, tantalum, niobium, vanadium, zirconium, and/or hafnium. The one or more buffer layers are generally interposed between the hardbanding (when utilized) and one or more coating layers or between coating layers. The buffer layer thickness may be a fraction of or approach the thickness of the coating layer.

In yet another embodiment of the coated oil and gas well production devices disclosed herein, the body assembly may further include one or more buttering layers interposed between the outer surface of the body assembly and the coating or hardbanding layer on at least a portion of the exposed outer surface to provide enhanced toughness, to minimize any dilution from the substrate steel alloying into the outer coating or hardbanding, and to minimize residual stress absorption. Non-limiting exemplary buttering layers include stainless steel or a nickel based alloy. The one or more buttering layers are generally positioned adjacent to or on top of the body assembly of the oil and gas well production device for coating.

In one advantageous embodiment of the coated oil and gas well production device disclosed herein, multilayered carbon based amorphous coating layers, such as diamond-like-carbon (DLC) coatings, may be applied to the device. The diamond-like-carbon (DLC) coatings suitable for oil and gas well production device may be chosen from ta-C, ta-C:H, DLCH, PLCH, GLCH, Si-DLC, Me-DLC, N-DLC, O-DLC, B-DLC, F-DLC and combinations thereof. One particularly advantageous DLC coating for such applications is DLCH or ta-C:H. The structure of multi-layered DLC coatings may include individual DLC layers with adhesion or buffer layers between the individual DLC layers. Exemplary adhesion or buffer layers for use with DLC coatings include, but are not limited to, the following elements or alloys of the following elements: silicon, titanium, chromium, tungsten, tantalum, niobium, vanadium, zirconium, and/or hafnium. Other exemplary adhesion or buffer layers for use with DLC coatings include, but are not limited to, carbides, nitrides, carbo-nitrides, oxides of the following elements: silicon, titanium, chromium, tungsten, tantalum, niobium, vanadium, zirconium, and/or hafnium. These buffer or adhesive layers act as toughening and residual stress relieving layers and permit the total DLC coating thickness for multi-layered embodiments to be increased while maintaining coating integrity for durability.

In yet another advantageous form of the coated oil and gas well production devices disclosed herein, to improve the durability, mechanical integrity and downhole performance of relatively thin DLC coating layers, a hybrid coating approach may be utilized wherein one or more DLC coating layers may be deposited on a state-of-the-art hardbanding. This embodiment provides enhanced DLC-hardbanding interface strength and also provides protection to the downhole devices against premature wear should the DLC either wear away or delaminate. In another form of this embodiment, an advanced surface treatment may be applied to the steel substrate prior to the application of DLC layer(s) to extend the durability and enhance the wear, friction, fatigue and corrosion performance of DLC coatings. Advanced surface treatments may be chosen from ion implantation, nitriding, carburizing, shot peening, laser and electron beam glazing, laser shock peening, and combinations thereof. Such surface treatment can harden the substrate surface by introducing additional species and/or introduce deep compressive residual stress resulting in inhibition of the crack growth induced by impact and wear damage. In yet another form of this embodiment, one or more buttering layers as previously described may be interposed between the substrate and the hardbanding with one or more DLC coating layers interposed on top of the hardbanding.

Figure 26:
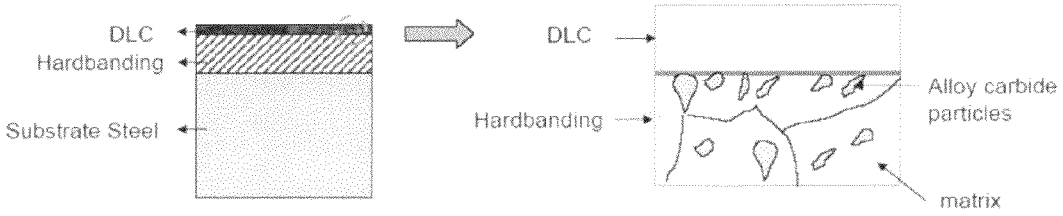
FIG. 26 depicts an exemplary schematic of hybrid DLC coating on hardbanding for drill stem assemblies.

FIG. 26 is an exemplary embodiment of a coating on an oil and gas well production device utilizing multi-layer hybrid coating layers, wherein a DLC coating layer is deposited on top of hardbanding on a steel substrate. In another form of this embodiment, the hardbanding may be post-treated (e.g., etched) to expose the alloy carbide particles to enhance the adhesion of DLC coatings to the hardbanding as also shown in FIG. 26. Such hybrid coatings can be applied to downhole devices such as the tool joints and stabilizers to enhance the durability and mechanical integrity of the DLC coatings deposited on these devices and to provide a "second line of defense" should the outer layer either wear-out or delaminate, against the aggressive wear and erosive conditions of the downhole environment in subterraneous rotary drilling operations. In another form of this embodiment, one or more buffer layers and/or one or more buttering layers as previously described may be included within the hybrid coating structure to further enhance properties and performance oil and gas well drilling, completions and production operations.

These coating technologies provide potential benefits to oil and gas well production operations, including, but not limited to drilling, completions, stimulation, workover, and production operations. Efficient and reliable drilling, completions, stimulation, workover, and production operations may be enhanced by the application of such coatings to devices to mitigate friction, wear, erosion, corrosion, and deposits, as was discussed in detail above.

Drilling Conditions, Applications and Benefits:

The coated oil and gas well production devices disclosed herein provide particular benefit in downhole drilling operation, and in particular for coated drill stem assemblies. A drill assembly includes a body assembly with an exposed outer surface that includes a drill string coupled to a bottom hole assembly, or alternatively a coiled tubing coupled to a bottom hole assembly, or alternatively cutting elements affixed to the bottom end of the casing comprising a "casing-while-drilling" system. The drill string includes one or more devices chosen from drill pipe, tool joints, transition pipe between the drill string and bottom hole assembly including tool joints, heavy weight drill pipe including tool joints and wear pads, and combinations thereof. The bottom hole assembly includes one or more devices chosen from, but not limited to: stabilizers, variable-gauge stabilizers, back reamers, drill collars, flex drill collars, rotary steerable tools, roller reamers, shock subs, mud motors, logging while drilling (LWD) tools, measuring while drilling (MWD) tools, coring tools, underreamers, hole openers, centralizers, turbines, bent housings, bent motors, drilling jars, acceleration jars, crossover subs, bumper jars, torque reduction tools, float subs, fishing tools, fishing jars, washover pipe, logging tools, survey tool subs, non-magnetic counterparts of any of these devices, and combinations thereof and their associated external connections.

The coatings disclosed herein may be deposited on at least a portion of or on all of the drill string, and/or bottom hole assembly, and/or the coiled tubing of a drill stem assembly, and/or the drilling casing used in a "casing-while-drilling" system. Hence, it is understood that the coatings and hybrid forms of the coating may be deposited on many combinations of the drill string devices and/or bottom hole assembly devices described above. When coated on the drill string, the coatings disclosed herein may prevent or delay the onset of drill string buckling including helical buckling for preventing drill stem assembly failures and the associated non-productive time during drilling operations. Moreover, the coatings disclosed herein may also provide resistance to torsional vibration instability including stick-slip vibration dysfunction of the drill string and bottom hole assembly.

The coated oil and gas well production devices disclosed herein may be used in drill stem assemblies with downhole temperature ranging from 20 to 400° F. with a lower limit of 20, 40, 60, 80, or 100° F., and an upper limit of 150, 200, 250, 300, 350 or 400° F. During rotary drilling operations, the drilling rotary speeds at the surface may range from 0 to 200 RPM with a lower limit of 0, 10, 20, 30, 40, or 50 RPM and an upper limit of 100, 120, 140, 160, 180, or 200 RPM. In addition, during rotary drilling operations, the drilling mud pressure may range from 14 psi to 20,000 psi with a lower limit of 14, 100, 200, 300, 400, 500, or 1000 psi, and an upper limit of 5000, 10000, 15000, or 20000 psi.

When used on drill string assemblies, the coatings disclosed herein may reduce the required torque for drilling operation, and hence may allow the drilling operator to drill the oil and gas wells at higher rate of penetration (ROP) than when using conventional drilling equipment. In addition, the coatings disclosed herein provide wear resistance and low surface energy for the drill stem assembly that is advantageous to that of conventional hardbanded drill stem assemblies while reducing the wear on the well casing.

In one form, the coated oil and gas well production devices disclosed herein with the coating on at least a portion of the exposed outer surface provides at least 2 times, or 3 times, or 4 times or 5 times greater wear resistance than an uncoated device. Additionally, the coated oil and gas well production device disclosed herein when used on a drill stem assembly with the coating on at least a portion of the surface provides reduction in casing wear as compared to when an uncoated drill stem assembly is used for rotary drilling. Moreover, the coated oil and gas well production devices disclosed herein when used on a drill stem assembly with the coating on at least a portion of the surface reduces casing wear by at least 2 times, or 3 times, or 4 times, or 5 times versus the use of an uncoated drill stem assembly for rotary drilling operations.

The coatings on drill stem assemblies disclosed herein may also eliminate or reduce the velocity weakening of the friction coefficient. More particularly, rotary drilling systems used to drill deep boreholes for hydrocarbon exploration and production often experience severe torsional vibrations leading to instabilities referred to as "stick-slip" vibrations, characterized by (i) sticking phases where the bit or BHA slows down until it stops (relative sliding velocity is zero), and (ii) slipping phases where the relative sliding velocity of the above assembly downhole rapidly accelerates to a value much larger than the average sliding velocity imposed by the rotary speed (RPM) imposed at the drilling rig. This problem is particularly acute with drag bits, which consist of fixed blades or cutters mounted on the surface of a bit body. Non-linearities in the constitutive laws of friction lead to the instability of steady frictional sliding against stick-slip oscillations. In particular, velocity weakening behavior, which is indicated by a decreasing coefficient of friction with increasing relative sliding velocity, may cause torsional instability triggering stick-slip vibrations. Sliding instability is an issue in drilling since it is one of the primary founders which limits the maximum rate of penetration as described earlier. In drilling applications, it is advantageous to avoid the stick-slip condition because it leads to vibrations and wear, including the initiation of damaging coupled vibrations. By reducing or eliminating the velocity weakening behavior, the coatings on drill string assemblies disclosed herein bring the system into the continuous sliding state, where the relative sliding velocity is constant and does not oscillate (avoidance of stick-slip) or display violent accelerations or decelerations in localized RPM. Even with the prior art method of avoiding stick-slip motion with the use of a lubricant additive or pills to drilling muds, at high normal loads and small sliding velocities stick-slip motion may still occur. The coatings on drill stem assemblies disclosed herein may provide for no stick-slip motion even at high normal loads.

Bit and stabilizer balling occurs when the adhesive forces between the bit and stabilizer surface and rock cutting chips become greater than the cohesive forces holding the chip together. Therefore, in order to decrease bit balling, the adhesive forces between the deformable shale chip and the drill bit and stabilizer surface may be reduced. The coatings on drill stem assemblies disclosed herein provide low energy surfaces to provide low adherence surfaces for mitigating or reducing bit/stabilizer balling.

Methods for Coating Oil and Gas Well Production Devices:

The current invention also relates to methods for coating oil and gas well production devices. In one exemplary embodiment, a method for coating an oil and gas well production device comprises providing a coated oil and gas well production device comprising an oil and gas well production device including one or more cylindrical bodies, and a coating on at least a portion of the one or more cylindrical bodies, wherein the coating is chosen from an amorphous alloy, a heat-treated electroless or electro plated nickel-phosphorous based composite with a phosphorous content greater than 12 wt %, graphite, $MoS_2$, $WS_2$, a fullerene based composite, a boride based cermet, a quasicrystalline material, a diamond based material, diamond-like-carbon (DLC), boron nitride, and combinations thereof, and utilizing the coated oil and gas well production device in well construction, completion, or production operations.

In another exemplary embodiment, a method for coating an oil and gas well production device comprises providing an oil and gas well production device including one or more bodies with the proviso that the one or more bodies does not include a drill bit, and a coating on at least a portion of the one or more bodies, wherein the coating is chosen from an amorphous alloy, a heat-treated electroless or electro plated nickel-phosphorous based composite with a phosphorous content greater than 12 wt %, graphite, $MoS_2$, $WS_2$, a fullerene based composite, a boride based cermet, a quasicrystalline material, a diamond based material, diamond-like-carbon (DLC), boron nitride, and combinations thereof, and utilizing the coated oil and gas well production device in well construction, completion, or production operations.

In subterraneous rotary drilling operations, the drilling may be directional including, but not limited to, horizontal drilling or extended reach drilling (ERD). During horizontal drilling or extended reach drilling (ERD), the method may also include utilizing coatings on bent motors to assist with weight transfer to the drill bit. Weight transfer to the drill bit is facilitated during sliding operations (0 RPM) for directional hole drilling when using coatings on such bent motors since weight transfer to the bit is impeded by friction resistance at the locations of sliding contact between the BHA and wellbore.

The diamond based material may be chemical vapor deposited (CVD) diamond or polycrystalline diamond compact (PDC). In one advantageous embodiment, the coated oil and gas well production device is coated with a diamond-like-carbon (DLC) coating, and more particularly the DLC coating may be chosen from ta-C, ta-C:H, DLCH, PLCH, GLCH, Si-DLC, N-DLC, O-DLC, B-DLC, Me-DLC, F-DLC and combinations thereof. In another advantageous form of the DLC coating embodiment, hardbanding is utilized adjacent to the substrate.

In one form of the method for coating oil and gas well production devices, the one or more devices may be coated with diamond-like carbon (DLC). Coatings of DLC materials may be applied by physical vapor deposition (PVD), arc deposition, chemical vapor deposition (CVD), or plasma enhanced chemical vapor deposition (PECVD) coating techniques. The physical vapor deposition coating method may be chosen from sputtering, RF-DC plasma reactive magnetron sputtering, ion beam assisted deposition, cathodic arc deposition and pulsed laser deposition. The one or more DLC coating layers may be advantageously deposited by PECVD and/or RF-DC plasma reactive magnetron sputtering methods.

The method for coating an oil and gas well production device disclosed herein provides substantial reduction in torque during drilling operations by substantially reducing friction and drag during directional or extended reach drilling facilitating drilling deeper and/or longer reach wells with existing top drive capabilities. Substantial reduction in torque means a 10% reduction, to preferably 20% reduction and more preferably 30% as compared to when an uncoated drill stem assembly is used for rotary drilling. Substantially reducing friction and drag means a 10% reduction, preferably 20% reduction and more preferably 50% as compared to when an uncoated drill stem assembly is used for rotary drilling. The method for reducing friction in a coated drill stem assembly may further include applying the coating on at least a portion of the exposed outer surface of the body assembly at the drilling rig site in the field or at a local supplier shop to apply new or refurbish worn coatings to extend the life and facilitate continued use of the assembly.

In one advantageous form of the method for coating an oil and gas well production device disclosed herein, the coating includes diamond-like-carbon (DLC). One exemplary method for applying the diamond-like-carbon (DLC) coating includes evacuating at least a portion of the exposed outer surface of the device through a means for mechanical sealing and pumping down prior to vapor deposition coating. In drilling applications, either a drill string or coiled tubing may be used in conjunction with the bottom hole assembly to form the drill stem assembly. When utilizing coated coiled tubing in subterraneous rotary drilling operations with the methods for reducing friction disclosed herein, the method provides for underbalanced drilling to reach targeted total depth without the need for drag reducing additives in the mud.

When utilizing the coated devices disclosed herein in drilling operations, the method for coating an oil and gas well production device for reducing friction in a coated drill stem assembly during subterraneous rotary drilling operations provides for substantial friction and drag reduction without compromising the aggressiveness of a drill bit connected to the coated drill stem assembly to transmit applied torque to rock fragmentation process. Indeed, the coated devices allow a more aggressive bit to be used since more of the available torque and power will be delivered to the bit and not lost to parasitic friction due to sliding contact of the drill stem assembly. Substantial friction and drag to reduction means that a 10% reduction, preferably 20% reduction and more preferably 50% reduction as compared to when an uncoated drill stem assembly is used for rotary drilling. In addition, the method for coating an oil and gas well production device for reducing friction in a coated drill stem assembly during subterraneous rotary drilling operations disclosed herein, the corrosion resistance of the coating is at least equal to the steel used for the body assembly of the drill stem assembly in the downhole drilling environments.

Well Production Applications and Benefits:

The coated oil and gas well production devices disclosed herein provide for improved performance in drilling, completion, stimulation, injection, treatment, fracturing, acidizing, workover, and production operations. These applications may be considered more generally to be related to "well production." The benefits to these well production operations are derived from the reduction in friction, wear, corrosion, erosion, and resistance to deposits obtained by use of coated well production devices, as previously described in detail and as illustrated in the figures appended hereto.

Test Methods

Coefficient of friction was measured using ball-on-disk tester according to ASTM G99 test method. The test method requires two specimens—a flat disk specimen and a spherically ended ball specimen. A ball specimen, rigidly held by using a holder, is positioned perpendicular to the flat disk. The flat disk specimen slides against the ball specimen by revolving the flat disk of 2.7 inches diameter in a circular path. The normal load is applied vertically downward through the ball so the ball is pressed against the disk. The specific normal load can be applied by means of attached weights, hydraulic or pneumatic loading mechanisms. During the testing, the frictional forces are measured using a tension-compression load cell or similar force-sensitive devices attached to the ball holder. The friction coefficient can be calculated from the measured frictional forces divided by normal loads. The test was done at room temperature and 150° F. under various testing condition sliding speeds. Quartz or mild steel ball, 4 mm~5 mm diameter, was utilized as a counterface material.

Velocity strengthening or weakening was evaluated by measuring the friction coefficient at various sliding velocities using ball-on-disk friction tester by ASTM G99 test method described above.

Hardness was measured according to ASTM C1327 Vickers hardness test method. The Vickers hardness test method consists of indenting the test material with a diamond indenter, in the form of a right pyramid with a square base and an angle of 136 degrees between opposite faces subjected to a load of 1 to 100 kgf. The full load is normally applied for 10 to 15 seconds. The two diagonals of the indentation left in the surface of the material after removal of the load are measured using a microscope and their average is calculated. The area of the sloping surface of the indentation is calculated. The Vickers hardness is the quotient obtained by dividing the kgf load by the square mm area of indentation. The advantages of the Vickers hardness test are that extremely accurate readings can be taken, and just one type of indenter is used for all types of metals and surface treatments. The hardness of thin coating layer (e.g., less than 100 μm) has been evaluated by nanoindentation wherein the normal load (P) is applied to a coating surface by an indenter with well-known pyramidal geometry (e.g., Berkovich tip, which has a three-sided pyramid geometry). In nanoindentation small loads and tip sizes are used to eliminate or reduce the effect from the substrate, so the indentation area may only be a few square micrometers or even nanometers. During the course of the nanoindentation process, a record of the depth of penetration is made, and then the area of the indent is determined using the known geometry of the indentation tip. The hardness can be obtained by dividing the load (kgf) by the area of indentation (square mm).

Wear performance was measured by the ball on disk geometry according to ASTM G99 test method. The amount of wear, or wear volume loss of the disk and ball is determined by measuring the dimensions of both specimens before and after the test. The depth or shape change of the disk wear track was determined by laser surface profilometry and atomic force microscopy. The amount of wear, or wear volume loss of the ball was determined by measuring the dimensions of specimens before and after the test. The wear volume in ball was calculated from the known geometry and size of the ball.

Water contact angle was measured according to ASTM D5725 test method. The method referred to as "sessile drop method" measures a liquid contact angle goniometer using an optical subsystem to capture the profile of pure liquid on a solid substrate. A drop of liquid (e.g., water) was placed (or allowed to fall from a certain distance) onto a solid surface. When the liquid settled (has become sessile), the drop retained its surface tension and became ovate against the solid surface. The angle formed between the liquid/solid interface and the liquid/vapor interface is the contact angle. The contact angle at which the oval of the drop contacts the surface determines the affinity between the two substances. That is, a flat drop indicates a high affinity, in which case the liquid is said to "wet" the substrate. A more rounded drop (by height) on top of the surface indicates lower affinity because the angle at which the drop is attached to the solid surface is more acute. In this case the liquid is said to "not wet" the substrate. The sessile drop systems employ high resolution cameras and software to capture and analyze the contact angle.

EXAMPLES

Illustrative Example 1

Figure 19:
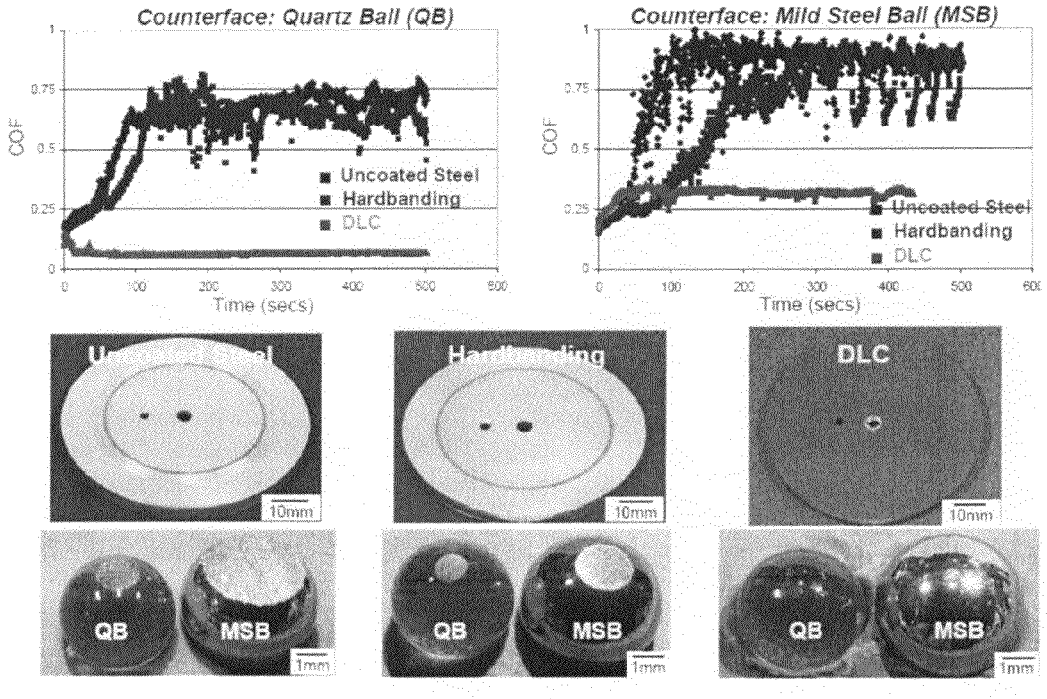
FIG. 19 depicts the friction and wear performance of DLC coating in a dry sliding wear test.

DLC coatings were applied on 4142 steel substrates by vapor deposition technique. DLC coatings had a thickness ranging from 1.5 to 25 micrometers. The hardness was measured to be in the range of 1,300 to 7,500 Vickers Hardness Number. Laboratory tests based on ball on disk geometry have been conducted to demonstrate the friction and wear performance of the coating. Quartz ball and mild steel ball were used as counterface materials to simulate open hole and cased hole conditions respectively. In one ambient temperature test, uncoated 4142 steel, DLC coating and commercial state-of-the-art hardbanding weld overlay coating were tested in "dry" or ambient air condition against quartz counterface material at 300 g normal load and 0.6 m/sec sliding speed to simulate an open borehole condition. Up to 10 times improvement in friction performance (reduction of friction coefficient) over uncoated 4142 steel and hardbanding could be achieved in DLC coatings as shown in FIG. 19.

In another ambient temperature test, uncoated 4142 steel, DLC coating and commercial state-of-the-art hardbanding weld overlay coating were tested against mild steel counterface material to simulate a cased hole condition. Up to three times improvement in friction performance (reduction of friction coefficient) over uncoated 4142 steel and hardbanding could be achieved in DLC coatings as shown in FIG. 19. The DLC coating polished the quartz ball due to higher hardness of DLC coating than that of counterface materials (i.e., quartz and mild steel). However, the volume loss due to wear was minimal in both quartz ball and mild steel ball. On the other hand, the plain steel and hardbanding caused significant wear in both the quartz and mild steel balls, indicating that these are not very "casing friendly".

Figure 20:
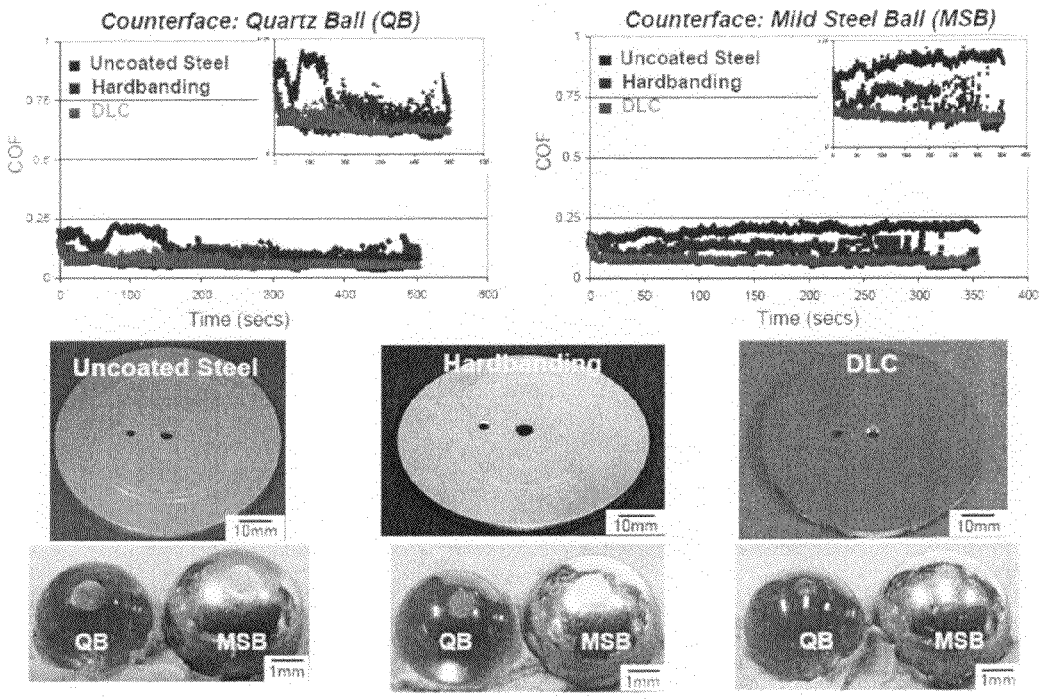
FIG. 20 depicts the friction and wear performance of the DLC coating in oil based mud.

Ball on disk wear and friction coefficient were also tested at ambient temperature in oil based mud. Quartz ball and mild steel balls were used as counterface materials to simulate open hole and cased hole respectively. The DLC coating exhibited significant advantages over commercial hardbanding as shown in FIG. 20. Up to 30% improvement in friction performance (reduction of friction coefficient) over uncoated 4142 steel and hardbanding could be achieved with DLC coatings. The DLC coating polished the quartz ball due to its to higher hardness than that of quartz. On the other hand, for the case of uncoated steel disk, both the mild steel and quartz balls as well as the steel disc showed significant wear. For a comparable test, the wear behavior of hardbanded disk was intermediate to that of DLC coated disc and the uncoated steel disc.

Figure 21:
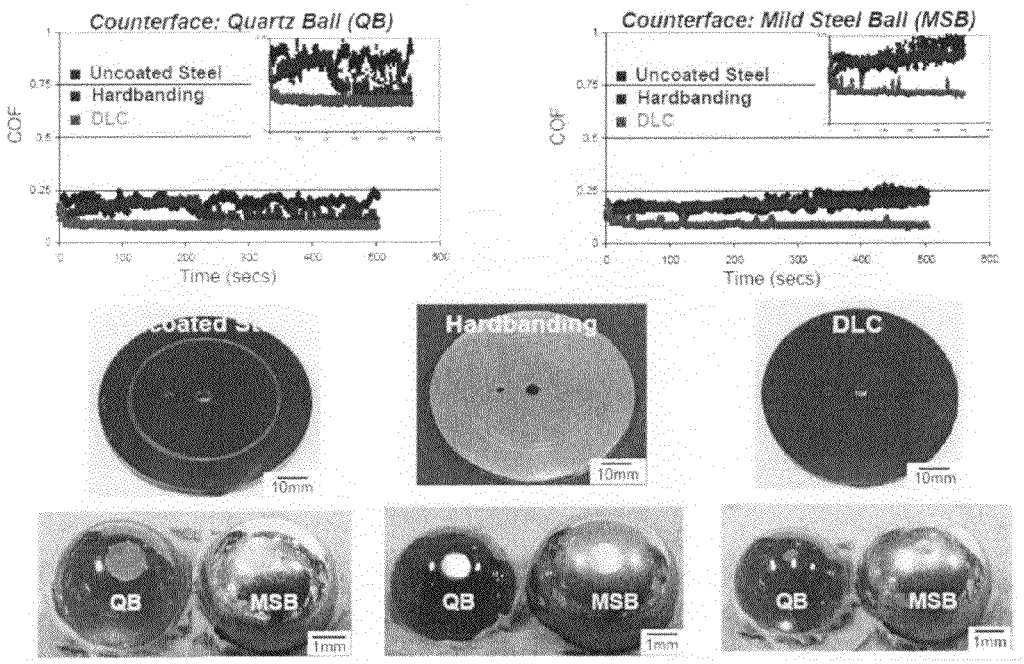
FIG. 21 depicts the friction and wear performance of DLC coating at elevated temperature (150° F.) sliding wear test in oil based mud.

FIG. 21 depicts the wear and friction performance at elevated temperatures. The tests were carried out in oil based mud heated to 150° F., and again the quartz ball and mild steel ball were used as counterface materials to simulate an open hole and cased hole condition respectively. DLC coatings exhibited up to 50% improvement in friction performance (reduction of friction coefficient) over uncoated 4142 steel and commercial hardbanding. Uncoated steel and hardbanding caused wear damage in the counterface materials of quartz and mild steel ball, whereas, significantly lower wear damage has been observed in the counterface materials rubbed against the DLC coating.

Figure 22:
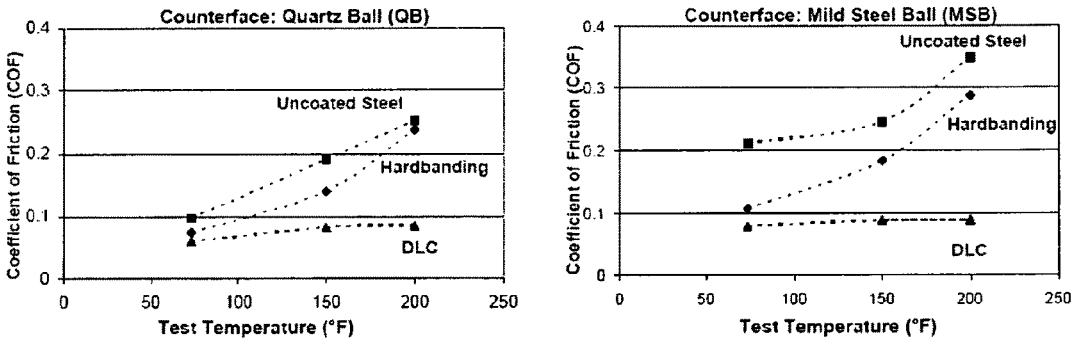
FIG. 22 depicts the friction performance of DLC coating at elevated temperatures (150° F. and 200° F.) in comparison to that of uncoated bare steel and hardbanding in oil based mud.

FIG. 22 shows the friction performance of DLC coating at elevated temperature (150° F. and 200° F.). In this test data, the DLC coatings exhibited low friction coefficient at elevated temperature up to 200° F. However, the friction coefficient of uncoated steel and hardbanding increased significantly with temperature.

Illustrative Example 2

Figure 23:
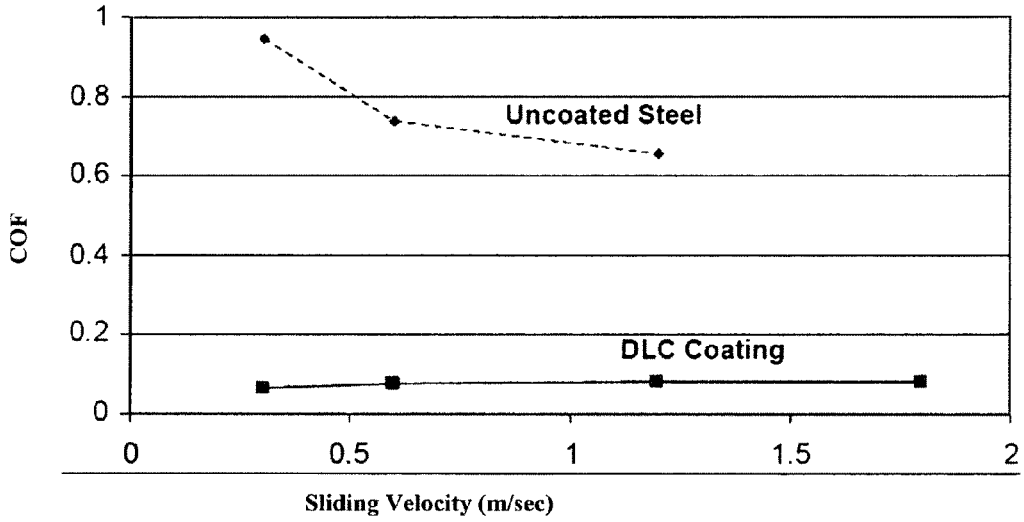
FIG. 23 depicts the velocity-weakening performance of DLC coating in comparison to an uncoated bare steel substrate.

In the laboratory wear/friction testing, the velocity dependence (velocity weakening or strengthening) of the friction coefficient for a DLC coating and uncoated 4142 steel was measured by monitoring the shear stress required to slide at a range of sliding velocity of 0.3 m/sec~1.8 m/sec. Quartz ball was used as a counterface material in the dry sliding wear test. The velocity-weakening performance of the DLC coating relative to uncoated steel is depicted in FIG. 23. Uncoated 4142 steel exhibits a decrease of friction coefficient with sliding velocity (i.e. significant velocity weakening), whereas DLC coatings show no velocity weakening and indeed, there seems to be a slight velocity strengthening of COF (i.e. slightly increasing COF with sliding velocity), which may be advantageous for mitigating torsional instability, a precursor to stick-slip vibrations.

Illustrative Example 3

Figure 24:
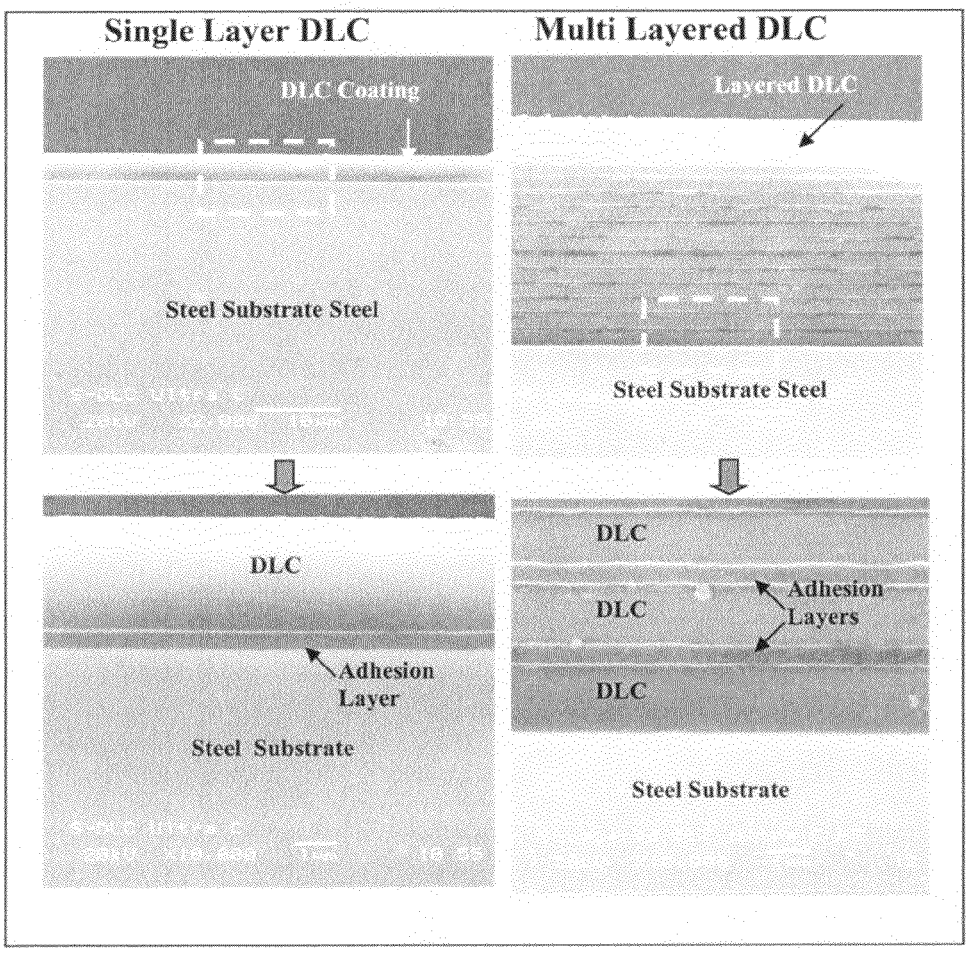
FIG. 24 depicts SEM cross-sections of single layer and multi-layered DLC coatings disclosed herein.

Multi-layered DLC coatings were produced in order to maximize the thickness of the DLC coatings for enhancing their durability for drill stem assemblies used in drilling operations. In one form, the total thickness of the multi-layered DLC coating varied from 6 μm to 25 μm FIG. 24 depicts SEM images of both single layer and multilayer DLC coatings for drill stem assemblies produced via PECVD. An adhesive layer(s) used with the DLC coatings was a siliceous buffer layer.

Illustrative Example 4

Figure 25:
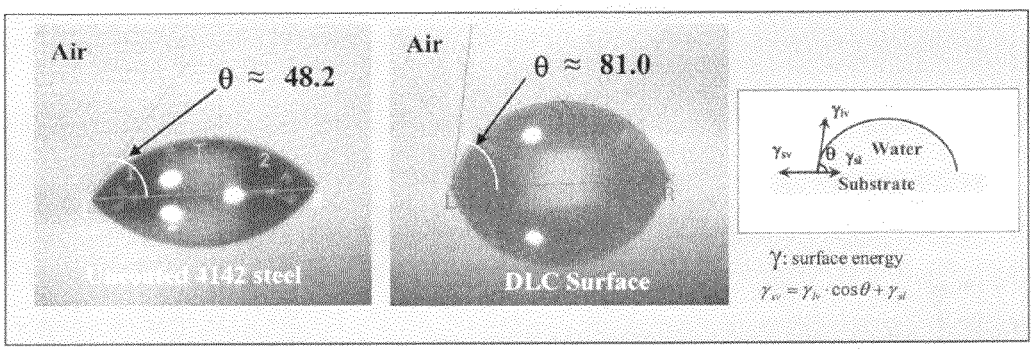
FIG. 25 depicts water contact angle for DLC coatings versus uncoated 4142 steel.

The surface energy of DLC coated substrates in comparison to an uncoated 4142 steel surface was measured via water contact angle. Results are depicted in FIG. 25 and indicate that a DLC coating provides a substantially lower surface energy in comparison to an uncoated steel surface. The lower surface energy may provide lower adherence surfaces for mitigating or reducing bit/stabilizer balling and to prevent formation of deposits of asphaltenes, paraffins, scale, and/or hydrates.

Applicants have attempted to disclose all embodiments and applications of the disclosed subject matter that could be reasonably foreseen. However, there may be unforeseeable, insubstantial modifications that remain as equivalents. While the present invention has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

All patents, test procedures, and other documents cited herein, including priority documents, are fully incorporated by reference to the extent such disclosure is not inconsistent with this invention and for all jurisdictions in is which such incorporation is permitted.

When numerical lower limits and numerical upper limits are listed herein, ranges from any lower limit to any upper limit are contemplated.

What is claimed is:

1. A coated oil and as well production device comprising:
an oil and gas well production device including one or more cylindrical bodies, and
a coating on at least a portion of the one or more cylindrical bodies,
wherein the coating is chosen from a fullerene based composite, diamond-like-carbon (DLC), and combinations thereof,
wherein the coefficient of friction of the coating is less than or equal to 0.15, and the coating provides a hardness greater than 1000 VHN.

2. The coated device of claim 1, wherein the one or more cylindrical bodies include two or more cylindrical bodies in relative motion to each other.

3. The coated device of claim 1, wherein the one or more cylindrical bodies are static relative to each other.

4. The coated device of claim 1, wherein the one or more cylindrical bodies include two or more radii.

5. The coated device of claim 4, wherein the one or more cylindrical bodies includes one or more cylindrical bodies substantially within one or more other cylindrical bodies.

6. The coated device of claim 4, wherein the two or more radii are of substantially the same dimensions or substantially different dimensions.

7. The coated device of claim 4, wherein the one or more cylindrical bodies are contiguous to each other.

8. The coated device of claim 4, wherein the one or more cylindrical bodies are not contiguous to each other.

9. The coated device of claim 7 or 8, wherein the one or more cylindrical bodies are coaxial or non-coaxial.

10. The coated device of claim 9, wherein the one or more cylindrical bodies have substantially parallel axes.

11. The coated device of claim 9, wherein the one or more non-coaxial cylindrical bodies are helical in inner surface, helical in outer surface or a combination thereof.

12. The coated device of claim 1, wherein the one or more cylindrical bodies are solid, hollow or a combination thereof.

13. The coated device of claim 1, wherein the one or more cylindrical bodies include at least one cylindrical body that is substantially circular, substantially elliptical, or substantially polygonal in outer cross-section, inner cross-section or inner and outer cross-section.

14. The coated device of claim 1, wherein the coefficient of friction of the coating is less than or equal to 0.10.

15. The coated device of claim 1, wherein the coating provides a hardness greater than 1500 VHN.

16. The coated device of claim 1, wherein the coating provides at least 3 times greater wear resistance than an uncoated device.

17. The coated device of claim 1, wherein the water contact angle of the coating is greater than 60 degrees.

18. The coated device of claim 1, wherein the coating provides a surface energy less than 1 $J/m^2$.

19. The coated device of claim 18, wherein the coating provides a surface energy less than 0.1 $J/m^2$.

20. The coated device of claim 1, wherein the coating comprises a single coating layer or two or more coating layers.

21. The coated device of claim 20, wherein the two or more coating layers are of substantially the same or different coatings.

22. The coated device of claim 20, wherein the thickness of the single coating layer and of each layer of the two or more coating layers range from 0.5 microns to 5000 microns.

23. The coated device of claim 20, wherein the coating further comprises one or more buffer layers.

24. The coated device of claim 23, wherein the one or more buffer layers are interposed between the surface of the one or more cylindrical bodies and the single coating layer or the two or more coating layers.

25. The coated device of claim 23, wherein the one or more buffer layers are chosen from elements, alloys, carbides, nitrides, carbo-nitrides, and oxides of the following:

silicon, titanium, chromium, tungsten, tantalum, niobium, vanadium, zirconium, or hafnium.

26. The coated device of claim 1, wherein the dynamic friction coefficient of the coating is not lower than 50% of the static friction coefficient of the coating.

27. The coated device of claim 1, wherein the dynamic friction coefficient of the coating is greater than or equal to the static friction coefficient of the coating.

28. The coated device of claim 1 , wherein the one or more cylindrical bodies further includes hardbanding on at least a portion thereof.

29. The coated device of claim 28, wherein the hardbanding comprises a cermet based material, a metal matrix composite or a hard metallic alloy.

30. The coated device of claim 1 or 28 wherein the one or more cylindrical bodies further includes a buttering layer interposed between the surface of the one or more cylindrical bodies and the coating or hardbanding on at least a portion of the cylindrical bodies.

31. The coated device of claim 30, wherein the buttering layer comprises a stainless steel or a nickel based alloy.

32. The coated device of claim 1, wherein the one or more cylindrical bodies further include threads.

33. The coated device of claim 32, wherein at least a portion of the threads are coated.

34. The coated device of claim 32 or 33, further comprising a sealing surface, wherein at least a portion attic sealing surface is coated.

35. The coated device of any one of claim 1, 2 or 3, wherein the one or more cylindrical bodies are well construction devices.

36. The coated device of claim 34, wherein the well construction devices are chosen from drill stem, casing, tithing string, wireline/braided line/multi-conductor/single conductor/slickline; coiled tubing, vaned rotors and stators of Moyno™ and progressive cavity pumps, expandable tubulars, expansion mandrels, centralizers, contact rings, wash pipes, shaker screens for solids control, overshot and grapple, marine risers, surface flow lines, and combinations thereof.

37. The coated device of any one of claim 1, 2 or 3, wherein the one or more cylindrical bodies are completion and production devices.

38. The coated device of claim 36, wherein the completion and production devices are chosen from plunger lifts; completion sliding sleeve assemblies; coiled tubing; sucker rods; Corods™; tubing string; pumping jacks; stuffing boxes; packoffs and lubricators; pistons and piston liners; vaned rotors and stators of Moyno™ and progressive cavity pumps; expandable tubulars; expansion mandrels; control lines and conduits; tools operated in well bores; wireline/braided line/multi-conductor/single conductor/slickline; centralizers; contact rings; perforated basepipe; slotted basepipe; screen basepipe for sand control; wash pipes; shunt tubes; service tools used in gravel pack operations; blast joints; sand screens disposed within completion intervals; Mazeflo™ completion screens; sintered screens; wirewrap screens; shaker screens for solids control; overshot and grapple; marine risers; surface flow lines, stimulation treatment lines, and combination thereof.

39. A coated oil and gas well production device comprising:

an oil and gas well production device including one or more bodies with the proviso that the one or more bodies does not include a drill bit, and a coating on at least a portion of the one or more bodies, wherein the coating is chosen from a fullerne based composite, diamond-like-carbon (DLC), and combinations thereof, wherein the coefficient of friction of the coating is less than or equal to 0.15, and the coating provides a hardness greater than 1000 VHN.

40. The coated device of claim 39, wherein the one or more bodies include two or more bodies in relative motion to each other.

41. The coated device of clams 39, wherein the one or more bodies are static relative to each other.

42. The coated device of clams 39, Therein the one or more bodies include spheres and complex geometries.

43. The coated device of claim 42, wherein the complex geometries have at least a portion that is non-cylindrical in shape.

44. The coated device of claim 43, wherein the one or more bodies include one or more bodies substantially within one or more other bodies.

45. The coated device of claim 39, wherein the one or more bodies are contiguous to each other.

46. The coated device of claim 39, wherein the one or more bodies are not contiguous to each other.

47. The coated device of claim 45 or 46, wherein the one or more bodies are coaxial or non-coaxial.

48. The coated device of claim 39, wherein the one or more bodies are solid, hollow or a combination thereof.

49. The coated device of claim 39, wherein the one or more bodies include at least one body that is substantially circular, substantially elliptical, or substantially polygonal in outer cross-section, inner cross-section or inner and outer cross-section.

50. The coated device of claim 39, wherein the coefficient of friction of the coating is less than or equal to 0.10.

51. The coated device of claim 39, wherein the coating provides a hardness greater than 1500 VHN.

52. The coated device of claim 39, wherein the coating provides at least 3 times greater wear resistance than an uncoated device.

53. The coated device of claim 39, wherein the water contact angle of the coating is greater than 60 degrees.

54. The coated device of claim 39, wherein the coating provides a surface energy less than 1 $J/m^2$.

55. The coated device of claim 54, wherein the coating provides a surface energy less than 0.1 $J/m^2$.

56. The coated device of claim 39, wherein the coating comprises a single coating layer or two or more coating layers.

57. The coated device of claim 56, wherein the two or more coating layers are of substantially the same or different coatings.

58. The coated device of claim 56, wherein the thickness of the single coating layer and of each layer of the two or more coating layers range from 0.5 microns to 5000 microns.

59. The coated device of claim 56, wherein the coating further comprises one or more buffer layers.

60. The coated device of claim 59, wherein the one or more buffer layers are interposed between the surface of the one or more cylindrical bodies and the single coating layer or the two or more coating layers.

61. The coated device of claim 59, wherein the one or more buffer layers are chosen from elements, alloys, carbides, nitrides, carbo-nitrides, and oxides of the following: silicon, titanium, chromium, tungsten, tantalum, niobium, vanadium, zirconium, or hafnium.

62. The coated device of claim 39, wherein the dynamic friction coefficient of the coating is not lower than 50% of the static friction coefficient of the coating.

63. The coated device of claim 39, wherein the dynamic friction coefficient of the coating is greater than or equal to the static friction coefficient of the coating.

64. The coated device of claim 39, wherein the one or more bodies further includes hardbanding on at least a portion thereof.

65. The coated device of claim 64, wherein the hardbanding comprises a cermet based material, a metal matrix composite or a hard metallic alloy.

66. The coated device of claim 39 or 64 wherein the one or more bodies further includes a buttering layer interposed between the surface of the one or more bodies and the coating or hardbanding on at least a portion of the bodies.

67. The coated device of claim 66, wherein the buttering layer comprises a stainless steel or a nickel based alloy.

68. The coated device of claim 39, wherein the one or more bodies firth include threads.

69. The coated device of claim 68, wherein at least a portion of the threads are coated.

70. The coated device of claim 68 or 69, further comprising a sealing surface, wherein at least a portion of the sealing surface is coated.

71. The coated device of any one of claim 39, 40 or 41, wherein the one or more bodies are well construction devices.

72. The coated device of claim 71, wherein the well construction devices are chosen from chokes, valves, valve seats, nipples, ball valves, annular isolation valves, subsurface safety valves, centrifuges, elbows, tees, couplings, blowout preventers, wear bushings, dynamic metal-to-metal seals in reciprocating and/or rotating seals assemblies, springs in safety valves, shock subs, and jar, logging tool arms, rig skidding equipment, pallets, and combinations thereof.

73. The coated device of any one of claim 39, 40 or 41, wherein the one or more bodies are completion and production devices.

74. The coated device of claim 73, wherein the completion and production devices are chosen from chokes, valves, valve seats, nipples, ball valves, inflow control devices, smart well valves, annular isolation valves, subsurface safety valves, centrifuges, gas lift and chemical injection valves, elbows, tees, couplings, blowout preventers, wear bushings, dynamic metal-to-metal seals in reciprocating and/or rotating seals assemblies, springs in safety valves, shock subs, and jar, logging tool arms, sidepockets, mandrels, packer slips, packer latches, sand probes, wellstream gauges, and combinations thereof.

75. A method for coating an oil and gas well production device comprising:

providing a coated oil and gas well production device comprising an oil and gas well production device including one or more cylindrical bodies, and a coating on at east a portion of the one or more cylindrical bodies, wherein the coating is chosen from a fullerene based composite, diamond-like-carbon (DLC), and combinations thereof, wherein the coefficient of friction of the coating is less than or equal to 0.15, and the coating provides a hardness greater than 1000 VHN, and utilizing the coated oil and gas well production device in well construction, completion, or production operations.

76. The method of claim 75, wherein the one or more cylindrical bodies include two or more cylindrical bodies in relative motion to each other.

77. The method of claim 75, wherein the one or more cylindrical bodies are static relative to each other.

78. The method of claim 75, wherein the one or more cylindrical bodies include two or more radii.

79. The method of claim 78, wherein the one or more cylindrical bodies includes one or more cylindrical bodies substantially within one or more other cylindrical bodies.

80. The method of claim 78, wherein the two or more radii are of substantially the same dimensions or substantially different dimensions.

81. The method of claim 78, wherein the one or more cylindrical bodies are contiguous to each other.

82. The method of claim 78, wherein the one or more cylindrical bodies are not contiguous to each other.

83. The method of claim 81 or 82, wherein the one or more cylindrical bodies are coaxial or non-coaxial.

84. The method of claim 83, wherein the one or more non-coaxial cylindrical bodies have substantially parallel axes.

85. The method of claim 83, wherein the one or more non-coaxial cylindrical bodies are helical in inner surface, helical in outer surface or a combination thereof.

86. The method of claim 75, wherein the one or more cylindrical bodies are solid, hollow or a combination thereof.

87. The method of claim 75, wherein the one or more cylindrical bodies include at least one cylindrical body that is substantially circular, substantially elliptical, or substantially polygonal in outer cross-section, inner cross-section or inner and outer cross-section.

88. The method of claim 75, wherein the coefficient of friction of the coating is less than or equal to 0.10.

89. The method of claim 75, wherein the coating provides at least 3 times greater wear resistance than an uncoated device.

90. The method of claim 75, wherein the water contact angle of the coating is greater than 60 degrees.

91. The method of claim 75, wherein the coating provides a surface energy less than 1 $J/m^2$.

92. The method of claim 75, wherein the coating comprises a single coating layer or two or more coating layers.

93. The method of claim 92, wherein the two or more coating layers are of substantially the same or different coatings.

94. The method of claim 92, wherein the thickness of the single coating layer and of each layer of the two or more coating layers range from 0.5 microns to 5000 microns.

95. The method of claim 92, wherein the coating further comprises one or more buffer layers.

96. The method of claim 95, wherein the one or more buffer layers are interposed between the surface of the one or more cylindrical bodies and the single coating layer or the two or more coating layers.

97. The method of claim 95, wherein the one or more buffer layers are chosen from elements, alloys, carbides, nitrides, carbo-nitrides, and oxides of the following: titanium, chromium, tungsten, tantalum, niobium, vanadium, zirconium, or hafnium.

98. The method of claim 75, wherein the dynamic friction coefficient of the coating is not lower than 50% of the static friction coefficient of the coating.

99. The method of claim 75, wherein the dynamic friction coefficient of the coating is greater than or equal to the static friction coefficient of the coating.

100. The method of claim 75, wherein the one or more cylindrical bodies further includes hardbanding on at least a portion thereof.

101. The method of claim 100, wherein the hardbanding comprises a cermet based material, a metal matrix composite or a hard metallic alloy.

102. The method of claim 75 or 100, wherein the one or more cylindrical bodies further includes a buttering layer interposed between the surface of the one or more cylindrical bodies and the coating or hardbanding on at least a portion of the cylindrical bodies.

103. The method of claim 102, wherein the buttering layer comprises a stainless steel or a nickel based alloy.

104. The method of claim 75, wherein the one or more cylindrical bodies further include threads.

105. The method of claim 104, wherein at least a portion of the threads are coated.

106. The method of claim 104 or 105, further comprising a sealing surface, wherein at least a portion of the sealing surface is coated.

107. The method of any one of claim 75, 76, or 77, wherein the one or more cylindrical bodies are well construction devices.

108. The method of claim 107, wherein the well construction devices are chosen from drill stem, casing, tubing string, wireline/braided line/multi-conductor/single conductor/slickline; coiled tubing, vaned rotors and stators of Moyno™ and progressive cavity pumps, expandable tubulars, expansion mandrels, centralizers, contact rings, wash pipes, shaker screens fur solids control, overshot and grapple, marine risers, surface flow lines, and combinations thereof.

109. The method of any one of claim 75, 76, or 77, wherein the one or more cylindrical bodies are completion and production devices.

110. The method of claim 109, wherein the completion and production devices are chosen from plunger lifts; completion sliding sleeve assemblies; coiled tubing; sucker rods; Corods™; tubing string; pumping jacks; stuffing boxes; packoffs and lubricators; pistons and piston liners; vaned rotors and stators of Moyno™ and progressive cavity pumps; expandable tubulars; expansion mandrels; control lines and conduits; tools operated in well bores; wireline/braided line/multi-conductor/single conductor/slickline; centralizers; contact rings; perforated basepipe; slotted basepipe; screen basepipe for sand control; wash pipes; shunt tubes; service tools used in gravel pack operations; blast joints; sand screens disposed within completion intervals; Mazeflo™ completion screens; sintered screens; wirewrap screens; shaker screens tier solids control; overshot and grapple; marine risers; surface flow lines, stimulation treatment lines, and combination thereof.

111. The method of claim 75, wherein the diamond-like-carbon (DLC) is applied by physical vapor deposition, chemical vapor deposition, or plasma assisted chemical vapor deposition coating techniques.

112. The method of claim 111, wherein the physical vapor deposition coating method is chosen from RF-DC plasma reactive magnetron sputtering, ion beam assisted deposition, cathodic arc deposition and pulsed laser deposition.

113. A method for coating an oil and gas well production device comprising:

providing an oil and gas well production device including one or more bodies with the proviso that the one or more bodies does not include a drill hit, and a coating on at least a portion of the one or more bodies, wherein the coating is chosen from a fullerene based composite, diamond-like-carbon (DLC), and combinations thereof, wherein the coefficient of friction of the coating is less than or equal to 0.15, and the coating provides a hardness greater than 1000 VHN, and utilizing the coated oil and gas well production device in well construction, completion, or production operations.

114. The method of claim 113, wherein the one or more bodies include two or more bodies in relative motion to each other.

115. The method of claim 113, wherein the one or more bodies are static relative to each other.

116. The method of claim 113, wherein the one or more bodies include spheres or complex geometries.

117. The method of claim 116, wherein the complex geometries have at least a portion that is non-cylindrical in shape.

118. The method of claim 114 or 115, wherein the one or more bodies include one or more bodies substantially within one or more other bodies.

119. The method of claim 114 or 115, wherein the one or more bodies are contiguous to each other.

120. The method of claim 114 or 115, wherein the one or more bodies are not contiguous to each other.

121. The method of claim 114 or 115, wherein the one or more bodies are coaxial or non-coaxial.

122. The method of claim 113, wherein the one or more bodies are solid, hollow or a combination thereof.

123. The method of claim 113, wherein the one or more bodies include at least one body that is substantially circular, substantially elliptical, or substantially polygonal in outer cross-section, inner cross-section or inner and outer cross-section.

124. The method of claim 113, wherein the coefficient of friction of the coating is less than or equal to 0.10.

125. The method of claim 113, wherein the coating provides at least 3 times greater wear resistance than an uncoated device.

126. The method of claim 113, wherein the water contact angle of the coating is greater than 60 degrees.

127. The method of claim 113, wherein the coating provides a surface energy less than 1 $J/m^2$.

128. The coated device of claim 113, wherein the coating comprises a single coating layer or two or more coating layers.

129. The method of claim 128, wherein the two or more coating layers are of substantially the same or different coatings.

130. The method of claim 128, wherein the thickness of the single coating layer and of each layer of the two or more coating layers range from 0.5 microns to 5000 microns.

131. The method of claim 128, wherein the coating further comprises one or more buffer layers.

132. The method of claim 131, wherein the one or more buffer layers are interposed between the surface of the one or more cylindrical bodies and the single coating layer or the two or more coating layers.

133. The method of claim 131, wherein the one or more buffer layers are chosen from elements, alloys, carbides, nitrides, carbo-nitrides, and oxides of the following: silicon, titanium, chromium, tungsten, tantalum, niobium, vanadium, zirconium, or hafnium.

134. The method of claim 113, wherein the dynamic friction coefficient of the coating is not lower than 50% of the static friction coefficient of the coating.

135. The method of claim 113, wherein the dynamic friction coefficient of the coating is greater than or equal to the static friction coefficient of the coating.

136. The method of claim 113, wherein the one or more bodies further includes hardbanding on at least a portion thereof.

137. The method of claim 136, wherein the hardbanding comprises a cermet based material, a metal matrix composite or a hard metallic alloy.

138. The method of claim 113 or 136 wherein the one or more bodies further includes a buttering layer interposed between the surface of the one or more bodies and the coating or hardbanding on at least a portion of the bodies.

139. The method of claim 138, wherein the buttering layer comprises a stainless steel or a nickel based alloy.

140. The method of claim 113, wherein the one or more bodies further include threads.

141. The method of claim 140, wherein at least a portion of the threads are coated.

142. The method of claim 140 or 141, further comprising a sealing surface, wherein at least a portion of the sealing surface is coated.

143. The method of any one of claim 113, 114, or 115, wherein the one or more bodies are well construction devices.

144. The method of claim 143, wherein the well construction devices are chosen from chokes, valves, valve seats, nipples, ball valves, annular isolation valves, subsurface safety valves, centrifuges, elbows, tees, couplings, blowout preventers, wear bushings, dynamic metal-to-metal seals in reciprocating and/or rotating seals assemblies, springs in safety valves, shock subs, and jar, logging tool arms, rig skidding equipment, pallets, and combinations thereof.

145. The method of any one of claim 113, 114, or 115, wherein the one or more bodies are completion and production devices.

146. The method of claim 145, wherein the completion and production devices are chosen from chokes, valves, valve seats, nipples, ball valves, inflow control devices, smart well valves, annular isolation valves, subsurface safety valves, centrifuges, gas lift and chemical injection valves, elbows, tees, couplings, blowout preventers, wear bushings, dynamic metal-to-metal seals in reciprocating and/or rotating seals assemblies, springs in safety valves, shock subs, and jar, logging tool arms, sidepockets, mandrels, packer slips, packer latches, sand probes, wellstream gauges, and combinations thereof.

147. The method of claim 113, wherein the diamond-like-carbon (DLC) is applied by physical vapor deposition, chemical vapor deposition, or plasma assisted chemical vapor deposition coating techniques.

148. The method of claim 147, wherein the physical vapor deposition coating method is chosen from RF-DC plasma reactive magnetron sputtering, ion beam assisted deposition, cathodic arc deposition and pulsed laser deposition.

* * * * *

UNITED STATES PATENT AND TRADEMARK OFFICE

CERTIFICATE OF CORRECTION

PATENT NO. : 8,261,841 B2
APPLICATION NO. : 12/583302
DATED : September 11, 2012
INVENTOR(S) : Hyun-Woo Jin et al.

It is certified that error appears in the above-identified patent and that said Letters Patent is hereby corrected as shown below:

In the Claims:

Claim 36 should depend from claim 35 and not claim 34 as indicated in the patent claims.
Claim 38 should depend from claim 37 and not claim 36 as indicated in the patent claims.

Signed and Sealed this
First Day of October, 2013

Teresa Stanek Rea
*Deputy Director of the United States Patent and Trademark Office*

UNITED STATES PATENT AND TRADEMARK OFFICE

CERTIFICATE OF CORRECTION

PATENT NO. : 8,261,841 B2
APPLICATION NO. : 12/583302
DATED : September 11, 2012
INVENTOR(S) : Hyun-Woo Jin et al.

It is certified that error appears in the above-identified patent and that said Letters Patent is hereby corrected as shown below:

In the Claims:

Column 41, Line 63, Claim 36 should depend from claim 35 and not claim 34 as indicated in the patent claims.
Column 42, Line 7, Claim 38 should depend from claim 37 and not claim 36 as indicated in the patent claims.

This certificate supersedes the Certificate of Correction issued October 1, 2013.

Signed and Sealed this
Twenty-second Day of October, 2013

Teresa Stanek Rea
*Deputy Director of the United States Patent and Trademark Office*